US011779827B2

(12) United States Patent
Lewis

(10) Patent No.: US 11,779,827 B2
(45) **Date of Patent: *Oct. 10, 2023**

(54) SYSTEM AND USER INTERFACE FOR OFFICIATING AND SPECTATING FLAG FOOTBALL

(71) Applicant: AFFL Associates, Inc., New York, NY (US)

(72) Inventor: Jeffrey Lewis, New York, NY (US)

(73) Assignee: AFFL Associates, Inc., New York, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/750,625

(22) Filed: May 23, 2022

(65) Prior Publication Data

US 2022/0362656 A1 Nov. 17, 2022

Related U.S. Application Data

(63) Continuation of application No. 16/670,744, filed on Oct. 31, 2019, now Pat. No. 11,338,191.

(Continued)

(51) Int. Cl.
*A63B 71/06* (2006.01)

(52) U.S. Cl.
CPC ..... *A63B 71/0669* (2013.01); *A63B 71/0622* (2013.01); *A63B 71/0686* (2013.01);

(Continued)

(58) Field of Classification Search
None
See application file for complete search history.

(56) References Cited

U.S. PATENT DOCUMENTS

2012/0099405 A1* 4/2012 Lidor ..... G07C 1/28 368/10
2013/0040764 A1* 2/2013 Daniels ..... A63B 69/00 473/439

(Continued)

OTHER PUBLICATIONS

PC Scoreboards. (Oct. 6, 2016) "Football Scoreboard Pro v2", located at http://www.pcscoreboards.com/footballscoreboardpro/. (3 pages).

(Continued)

*Primary Examiner* — Jason T Yen
(74) *Attorney, Agent, or Firm* — MORRISON & FOERSTER LLP

(57) ABSTRACT

Disclosed herein are devices, systems, and methods for officiating, spectating, and scorekeeping for flag football games using one or more wirelessly interconnected electronic devices. In some embodiments, a plurality of graphical user interfaces are provided on a mobile electronic device, the interfaces allowing game officials to create games that are visible to spectators, players, coaches, and statisticians/scorekeepers on a shared geographic map. After spectators, players, coaches, and/or statisticians/scorekeepers join a game, an official inputs information regarding timing and scorekeeping of the game to an interface of a mobile device carried by the official, and the inputted information is broadcasted from the official's device to mobile devices of spectators, players, and coaches, where it is displayed in real-time on graphical user interfaces of the receiving devices. The interfaces may facilitate real-time synchronization of a play-clock and/or go-clock amongst officials, spectators, players, coaches, and/or statisticians/scorekeepers.

20 Claims, 17 Drawing Sheets

Related U.S. Application Data

(60) Provisional application No. 62/755,848, filed on Nov. 5, 2018.

(52) U.S. Cl.
CPC ... *A63B 2071/0625* (2013.01); *A63B 2225/20* (2013.01); *A63B 2225/50* (2013.01)

(56) References Cited

U.S. PATENT DOCUMENTS

| | | | | |
|---|---|---|---|---|
| 2014/0179384 | A1* | 6/2014 | Minkovitch | G06Q 10/00 463/4 |
| 2016/0330362 | A1* | 11/2016 | Singleton | H04N 23/66 |
| 2018/0028895 | A1* | 2/2018 | Stanfield | H01M 10/486 |
| 2019/0076714 | A1* | 3/2019 | Dougherty | A63B 63/083 |

OTHER PUBLICATIONS

Andrews, K. (Nov. 11, 2016). "Victory Game Clocks, Auburn University Create eDown, The LED Football Down Marker," located at https://www.sporttechie.com/victory-game-clocks-and-auburn-university-release-edown/ visited on Nov. 3, 2019. (3 pages).
Lewis. U.S. Office Action dated Jan. 8, 2021, directed to U.S. Appl. No. 16/670,744; 9 pages.
Lewis. U.S. Office Action dated Sep. 23, 2021, directed to U.S. Appl. No. 16/670,744; 6 pages.

* cited by examiner

SYSTEM AND USER INTERFACE FOR OFFICIATING AND SPECTATING FLAG FOOTBALL

CROSS-REFERENCE TO RELATED APPLICATIONS

This application is a continuation of U.S. application Ser. No. 16/670,744, filed Oct. 31, 2019, which claims the priority of U.S. Provisional Patent Application No. 62/755,848, filed Nov. 5, 2018, the entire contents of each of which are incorporated herein by reference.

FIELD OF THE DISCLOSURE

This disclosure relates generally to officiating flag football and, more specifically, to a system and graphical user interface for officiating flag football.

BACKGROUND OF THE DISCLOSURE

Flag football is a type of gridiron football (American football) in which players wear flags that are attached to belts worn around the waist. When a player on the defense grabs and pulls on the flag of an offensive player who is advancing the ball, the flag detaches from the offensive player's belt and play is halted. Flag football may provide a safer alternative to tackle football, because high-impact collisions are not an integral part of the game.

In certain forms of flag football, as in many forms of tackle football, the offensive team may have a limited amount of time in which it is required to snap the ball to avoid being penalized for delay of game; in many forms of tackle football, this rule is enforced via use of a play clock integrated into an electronic scoreboard or another fixed stadium feature.

Additionally, in certain forms of flag football, rules regarding rushing and or downing the quarterback may differ from rules in tackle football. For example, flag football rules may dictate a period of time following the snap of the football during which defensive players are prohibited from rushing the quarterback. Furthermore, flag football rules may dictate a period of time following the snap of the football after which the quarterback may be automatically deemed down if the quarterback has failed to throw the football. These rules may further increase the safety of flag football by requiring fewer dedicated pass-rushing players and pass-blocking players and by making plays in which the quarterback is directly downed by a defensive player less common.

SUMMARY OF THE DISCLOSURE

As described above, flag football may provide a safer alternative to tackle football in which players are marked down in accordance with flags being pulled from their belts, rather than in accordance with being tackled. Furthermore, safety in flag football may be additionally increased by providing for (a) a time period following the snap before which defensive players may not rush the quarterback, and/or (b) a time period following the snap after which the quarterback may be automatically deemed down if he has not yet thrown the ball.

However, known systems and methods for enforcing the timing rules above in flag football have several flaws. Enforcement of conventional delay-of-game rules and enforcement of timing restrictions for rushing the quarterback in flag football may be difficult due to a lack of stadium scoreboard and/or electronic scoreboard equipment for many flag football games. Thus, these timing rules may go unenforced or may be enforced improperly when officials or players attempt to enforce the rules on the basis of a stopwatch, wrist-watch, or the like. Furthermore, even if an official using a stopwatch accurately enforces these timing rule in a flag football game without a scoreboard or stadium-integrated play clock, players may still be disadvantaged by not being able to see for themselves the amount of time left on the play clock or the amount of time remaining to rush the quarterback. Additionally, even if an official using a stopwatch accurately enforces a these timing rules in a flag football game without a scoreboard or stadium-integrated play clock, spectators may be unable to see timing information in real-time, detracting from the experience of watching the game. Thus, improper or non-optimal enforcement of timing rules, strategic influence on the game due to lack of real-time visibility of clock information for participants, and lack of visibility of clock information for spectators may all negatively affect flag football games.

Accordingly, there is a need for improved systems, methods, and techniques for officiating flag football, including in particular for officiating timing rules in flag football. Specifically, there is a need for improved systems, methods, and techniques for officiating flag football in such a way that timing rules may be accurately enforced and such that timing information may be readily visible, in real time, to officials, players, coaches, and spectators, including in situations when scoreboards and dedicated clock displays are not available.

Provided herein are systems and graphical user interfaces for coordinating the control, distribution, and display of timing information for flag football games. amongst officials, players, coaches, and spectators. As explained herein, the systems and interfaces disclosed herein may allow for a plurality of mobile electronic devices to communicate with one another to facilitate display of shared timing information, as well as other scoreboard information and game information amongst the interconnected mobile devices, such that officials, players, coaches, and spectators may all have coordinated information about the flag football game. As explained herein, the systems disclosed herein may provide various interfaces for control of game settings and real-time scoring and officiating of the game for use by officials, and may also provide various interfaces for viewing real-time information about the game for use by players, coaches, and spectators. As explained herein, information may be input to a controlling official's mobile device and may be broadcast to the mobile devices of players, coaches, and spectators, as well as to associated electronic devices such as scoreboards, displays, markers, smart flags, and/or smart balls. Wireless electronic communication amongst associated electronic devices in the system may in some embodiments enable displayed timers to automatically start and/or stop one or more of a play clock (to time the amount of time before a next play must be run), go-clock (to time the amount of time before defenders are allowed to rush the quarterback), or throw-clock (to time the amount of time before a quarterback is considered automatically downed if he has not yet thrown the ball).

In some embodiments, a first device is provided, the first device being for displaying timing information for officiating a flag football game is provided, the first device comprising: a touch-screen display; one or more processors; and memory storing instructions that, when executed by the one or more processors, cause the device to: display a graphical user interface comprising score information of a flag football game, game clock information of the game, down information of the game, and a first icon associated with a first timer and a second timer of the game, each of the first and second timer being distinct from the game clock; detect a first input at a location corresponding to the first icon; in response to detecting the first input, display the first timer; while the first timer is displayed, detect a second input; in response to detecting the second input, cease to display the first timer and display the second timer.

In some embodiments of the first device, the first timer counts down from a predetermined number of seconds and is associated with a delay-of-game rule.

In some embodiments of the first device, the second timer counts up from zero seconds and is associated with one or more of a go-clock rule and a throw-clock rule.

In some embodiments of the first device, detecting the second input comprises detecting a touch input at a predefined location of the touch-screen display.

In some embodiments of the first device, the instructions further cause the device to: in response to detecting the first input, send a first wireless electronic signal to one or more associated electronic devices, the first signal comprising instructions to display information regarding the first timer; and in response to detecting the second input, send a second wireless electronic signal to the one or more associated electronic devices, the second signal comprising instructions cease to display information regarding the first timer and to display information regarding the second timer.

In some embodiments of the first device, the one or more associated electronic devices comprise one or more of a portable electronic device, an electronic football sideline marker, and a scoreboard.

In some embodiments of the first device, the instructions further cause the device to: in response to detecting that the first timer has expired, generating and outputting a first notification; and in response to detecting that the second timer has expired, generating and outputting a second notification distinct from the first notification.

In some embodiments of the first device: the first notification comprises a first audible notification emitted by a speaker of the device; and the second notification comprises second audible notification, distinct from the first audible notification, emitted by the speaker of the device.

In some embodiments of the first device: the first notification comprises a third wireless electronic signal directed to one or more associated electronic devices, the third signal comprising instructions for the one or more associated electronic devices to generate and output a third audible or visible notification; and the second notification comprises a fourth wireless electronic signal directed to one or more associated electronic devices, the fourth signal comprising instructions for the one or more associated electronic devices to generate and output a fourth audible or visible notification, distinct from the third audible or visible notification.

In some embodiments, a first non-transitory computer-readable storage medium is provided, the first non-transitory computer-readable storage medium storing instructions for displaying timing information for officiating a flag football game, the instructions configured such that, when the instructions are executed by one or more processors of a system, the instructions cause the system to: display a graphical user interface comprising score information of a flag football game, game clock information of the game, down information of the game, and a first icon associated with a first timer and a second timer of the game, each of the first and second timer being distinct from the game clock; detect a first input at a location corresponding to the first icon; in response to detecting the first input, display the first timer; while the first timer is displayed, detect a second input; in response to detecting the second input, cease to display the first timer and display the second timer.

In some embodiments, a first method is provided, the first method being for displaying timing information for officiating a flag football game, the method comprising: at a system comprising a touch-screen display, one or more processors, and memory: displaying a graphical user interface comprising score information of a flag football game, game clock information of the game, down information of the game, and a first icon associated with a first timer and a second timer of the game, each of the first and second timer being distinct from the game clock; detecting a first input at a location corresponding to the first icon; in response to detecting the first input, displaying the first timer; while the first timer is displayed, detecting a second input; in response to detecting the second input, ceasing to display the first timer and displaying the second timer.

In some embodiments, a second device is provided, the second device being for obtaining and displaying information regarding a flag football game, the system comprising: a touch-screen display; one or more processors; and memory storing instructions that, when executed by the one or more processors, cause the device to: display a graphical user interface comprising a map of a location of a user of the device; for each of a plurality of scheduled flag football games, receive information about a respective geographic location of the game; for each of the plurality of scheduled flag football games, display, on the map, a respective indicator of the flag football game, wherein the indicators each comprise respective information regarding the scheduled game and are each located at a respective location on the map corresponding to the respective geographic location of the game; detect a first input at a location corresponding to a first one of the respective indicators; in response to detecting the first input, cease to display the map and display a spectator interface comprising score information and clock information associated with the game corresponding to the first one of the respective indicators.

In some embodiments of the second device, the instructions further cause the device to: receiving data from a mobile electronic device operated by a game official, the data comprising one or more of updated score information and updated clock information; in response to receiving the data, replacing display of one or more of the score information and the clock information with display of one or more of the updated score information and the updated clock information.

In some embodiments of the second device, receiving the data from the mobile electronic device operated by the game official comprises receiving a transmission via a direct wireless communications link between the device and the mobile electronic device operated by the game official.

In some embodiments of the second device, receiving the data from the mobile electronic device operated by the game official comprises receiving a transmission via one or more intermediate network devices.

In some embodiments, a second non-transitory computer-readable storage medium is provided, the second non-transitory computer-readable storage medium storing instructions for obtaining and displaying information regarding a flag football game, the instructions configured such that, when the instructions are executed by one or more processors of a system, the instructions cause the system to:

display a graphical user interface comprising a map of a location of a user of the device; for each of a plurality of scheduled flag football games, receive information about a respective geographic location of the game; for each of the plurality of scheduled flag football games, display, on the map, a respective indicator of the flag football game, wherein the indicators each comprise respective information regarding the scheduled game and are each located at a respective location on the map corresponding to the respective geographic location of the game; detect a first input at a location corresponding to a first one of the respective indicators; in response to detecting the first input, cease to display the map and display a spectator interface comprising score information and clock information associated with the game corresponding to the first one of the respective indicators.

In some embodiments, a second method is provided, the second method being for obtaining and displaying information regarding a flag football game, the method comprising: at a system comprising a touch-screen display, one or more processors, and memory: displaying a graphical user interface comprising a map of a location of a user of the device; or each of a plurality of scheduled flag football games, receiving information about a respective geographic location of the game; for each of the plurality of scheduled flag football games, displaying, on the map, a respective indicator of the flag football game, wherein the indicators each comprise respective information regarding the scheduled game and are each located at a respective location on the map corresponding to the respective geographic location of the game; detecting a first input at a location corresponding to a first one of the respective indicators; in response to detecting the first input, ceasing to display the map and displaying a spectator interface comprising score information and clock information associated with the game corresponding to the first one of the respective indicators.

In some embodiments, any of the limitations discussed above may apply alone and/or in combination with any one or more of the other limitations discussed above, as would be appreciated by a person of ordinary skill in the art in light of the present disclosure.

BRIEF DESCRIPTION OF THE DRAWINGS

The foregoing summary, as well as the following detailed description of embodiments, is better understood when read in conjunction with the appended drawings. For the purpose of illustrating the present disclosure, the drawings show exemplary embodiments of the disclosure; the disclosure, however, is not limited to the specific methods and instrumentalities disclosed. In the drawings.

DETAILED DESCRIPTION

Described herein are systems and graphical user interfaces for receiving, configuring, storing, configuring, distributing, synchronizing, and/or displaying information pertaining to officiating, playing, and spectating flag football.

Figure 1:
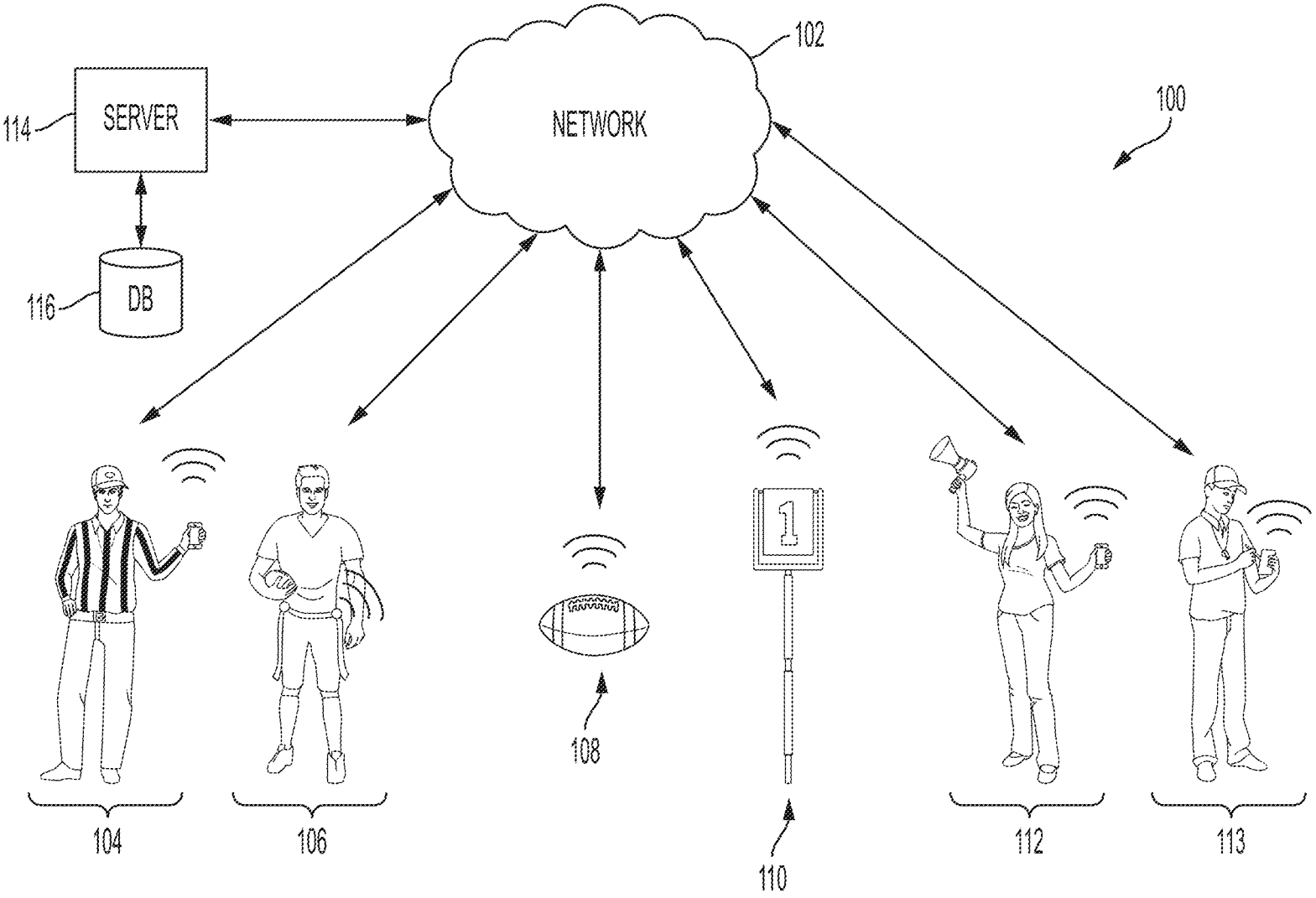
FIG. 1 shows a system for distributing and displaying information about a flag football game, in accordance with some embodiments.

FIG. 1 shows a system 100 for distributing and displaying information about a flag football game, in accordance with some embodiments. As discussed above, systems disclosed herein may enable the distribution of flag football game information in real time amongst a plurality of electronic devices associated with the flag football game. These electronic devices may include, in some embodiments, portable electronic devices such as smart phones and/or tablets, laptop and/or desktop computers, scoreboard equipment, sideline marker equipment, electronic flag football flags and/or belts, electronic footballs, and/or other electronic flag football equipment.

As shown in FIG. 1, system 300 may comprise a plurality of system components that may be associated with a flag football game, including by being (in some embodiments) located within a physical geographic proximity of the flag football game. These components may, in some embodiments, comprise mobile electronic device 104, which may operate in an "official" mode (discussed further below) and may be controlled by an official of the flag football game; flag belt set 106, which may be worn by a player in the flag football game; football 108, which may be used to play the flag football game; sideline marker 110, which may be positioned on a sideline and controlled by an official of the flag football game; mobile electronic device 112, which may operate in a "spectator" mode (discussed further below) and may be controlled by spectator (and/or player or coach) of the flag football game; and mobile electronic device 113, which may operate in "statistician" mode (discussed further below) and may be controlled by a statistician (and/or player, coach, official, or spectator) for the flag football game.

Any one or more of these components 104-113 contain one or more electronic (e.g., wireless) communication devices such that the components may communicate data by sending and receiving electronic signals to and from one another. Thus, the components 104-113 may be configured to send and receive information to, from, and/or between one another using any suitable electronic communication medium, such as one or more wireless communication protocols. In some embodiments, the one or more components may be configured to communicate directly with one another, such as via Bluetooth or by any other suitable wired or wireless electronic communication medium; in some embodiments, the one or more components may be configured to communicate with one another via one or more intermediate electronic devices, including by communicating via one or more networks, such as network 102. Network 102 may be any wired and/or wireless electronic communication network, including a public network, a private network, or the Internet.

Finally, system 100 may further comprise remote server 114, which may be a remote server configured to receive, send, and store data regarding one or more flag football games. In some embodiments, remote server 114 may control the distribution of information regarding a flag football game to the appropriate receiving devices, such that information uploaded by an official of a flag football game, whether before the game or during the game in real-time, may be distributed to the other electronic devices associated with the game. In some embodiments, remote server 114 may store information regarding scheduled future games, such as game location and team information, such that users may browse the information about the scheduled future games before the game begins and/or before the browsing user is in the physical geographic vicinity of any one or more of the electronic devices associated with any particular flag football game. In some embodiments, remote server 114 may store information in one or more associated databases, such as database 116.

In some embodiments, mobile electronic device 104 may be any mobile electronic device, such as a smart phone or tablet, configured to display a graphical user interface, configured to receive inputs from a user, and comprising one or more processors and one or more electronic communication devices for wired and/or wireless communication with other components of system 100. Exemplary graphical user interfaces for using mobile electronic device 104 to interact with system 100 are discussed below in more detail with respect to FIG. 2. As shown in FIG. 1, mobile electronic device 104 may be controlled by an official of the flag football game, and the device may operate in an "official" mode (discussed further below) which may allow the controlling official to input information about the flag football game, including real-time scoring and officiating information, which may be distributed to one or more other electronic devices of system 100.

In some embodiments, flag belt set 106 may comprise a flag football belt and one or more associated flags and/or connectors configured to electronically communicate with one or more other components of system 100. In some embodiments, the belt, flags, and/or connector may comprise one or more sensors such as a connection sensor, position sensor, accelerometer, time sensor, and/or other type of sensor configured to collect data about a state of the device for transmission to another component of system 100. In some embodiments, connectors configured to attach a flag to a belt (and/or another wearable item configured for use in flag football games) may be configured to detect when the flag has been detached from the belt and to generate a signal regarding a location and a time at which the detachment occurred. In some embodiments, information regarding the time and/or location at which the detachment occurred may be sent via the signal to one or more other components of system 100. In some embodiments, the information regarding time and/or location of detachment may be used in controlling one or more timers for the game and/or making one or more determinations regarding ball placement and/or scoring of the game (e.g., to determine a yard-line or location of the ball or of a player when the detachment occurred). In some embodiments, flag belt set 106 may include flags, one or more belts, one or more wearable garments, and/or flag connectors having one or more characteristics in common with the flag football equipment disclosed in U.S. provisional application No, 62/482,481, filed Apr. 6, 2017, and/or in U.S. provisional application No. 62/561,865, filed Sep. 22, 2017, both of which are hereby incorporated by reference in their entirety.

In some embodiments, football 108 may be a football configured to electronically communicate with one or more other components of system 100. In some embodiments, football 108 may comprise one or more sensors such as a position sensor, accelerometer, time sensor, and/or other type of sensor configured to collect data about a state of the ball for transmission to another component of system 100. In some embodiments, football 108 may be configured to determine information regarding the position of the football on the field (e.g., a yard-line of the football at a particular moment) or motion of the football (e.g., whether the ball has been snapped) and to transmit that information via a signal to one or more other components of set 300. In some embodiments, the transmitted information may be used in controlling one or more timers for the game and/or making one or more determinations regarding ball placement and/or scoring of the game (e.g., to determine a yard-line or location of the ball, to determine whether the ball was snapped before the play clock expired, etc.). In some embodiments, football 108 may have one or more characteristics in common with any one or more of the footballs disclosed in U.S. provisional application No. 62/626,617, filed Feb. 5, 2018, which is here by incorporated by reference in its entirety.

In some embodiments, sideline marker 110 may comprise an electronic flag football marker and/or scoreboard device configured to display information about a flag football game via one or more displays. For example, marker 108 may be a scoreboard system configured to display a score of the game, and/or a down marker system configured to display a current down of the game. In some embodiments, marker 108 may be positioned on a sideline and controlled by an official of the flag football game. In some embodiments, marker 108 may comprise one or more processors and one or more electronic communication devices for wired and/or wireless communication with other components of system 100. For example, marker 110 may, in some embodiments, receive information via wireless electronic communication from mobile device 104, such that marker 100 may display down information and/or a state of one or more timers (e.g., a game clock, play clock, go-clock, and/or throw clock) in coordination with the down information input to device 104 by the controlling official.

In some embodiments, additional sideline markers in system 100 may comprise one or more markers that each may share one or more characteristics in common with marker 110. In some embodiments, additional markers may be individually operable by a user and/or configured to send information regarding downs and/or timers to other components of system 100. In some embodiments, one or more markers of the system (including marker 100) may be passive, or may be configured to be able to be operated in a passive mode. In a passive mode, markers may be configured to receive data from other components of the system, including other markers, mobile device 104, and/or from other sources, but not to send data. In a passive mode, markers may be configured to "mirror" a marker and/or a mobile electronic device such as device 104, by displaying the same down and/or timer information as the mirrored device.

In some embodiments, one or more markers in system 100, including marker 110, may have one or more characteristics in common with any one or more of the markers disclosed in U.S. provisional application No. 62/626,617, filed Feb. 5, 2018.

In some embodiments, mobile electronic device 112 may be any mobile electronic device, such as a smart phone or tablet, configured to display a graphical user interface, configured to receive inputs from a user, and comprising one or more processors and one or more electronic communication devices for wired and/or wireless communication with other components of system 100. Exemplary graphical user interfaces for using mobile electronic device 104 to interact with system 100 are discussed below in more detail with respect to FIG. 2. As shown in FIG. 1, mobile electronic device 112 may be controlled by a spectator of the flag football game (though in some embodiments it may be controlled by a second official, a player, or a coach of the flag football game), and the device may operate in a "spectator" mode (discussed further below) which may allow the device to receive and display real-time game information (e.g., scoring and officiating information) coordinated with information entered into mobile device 104 by the controlling official, and/or coordinated with information transmitted by one or more other components of system 100.

Figure 2A:
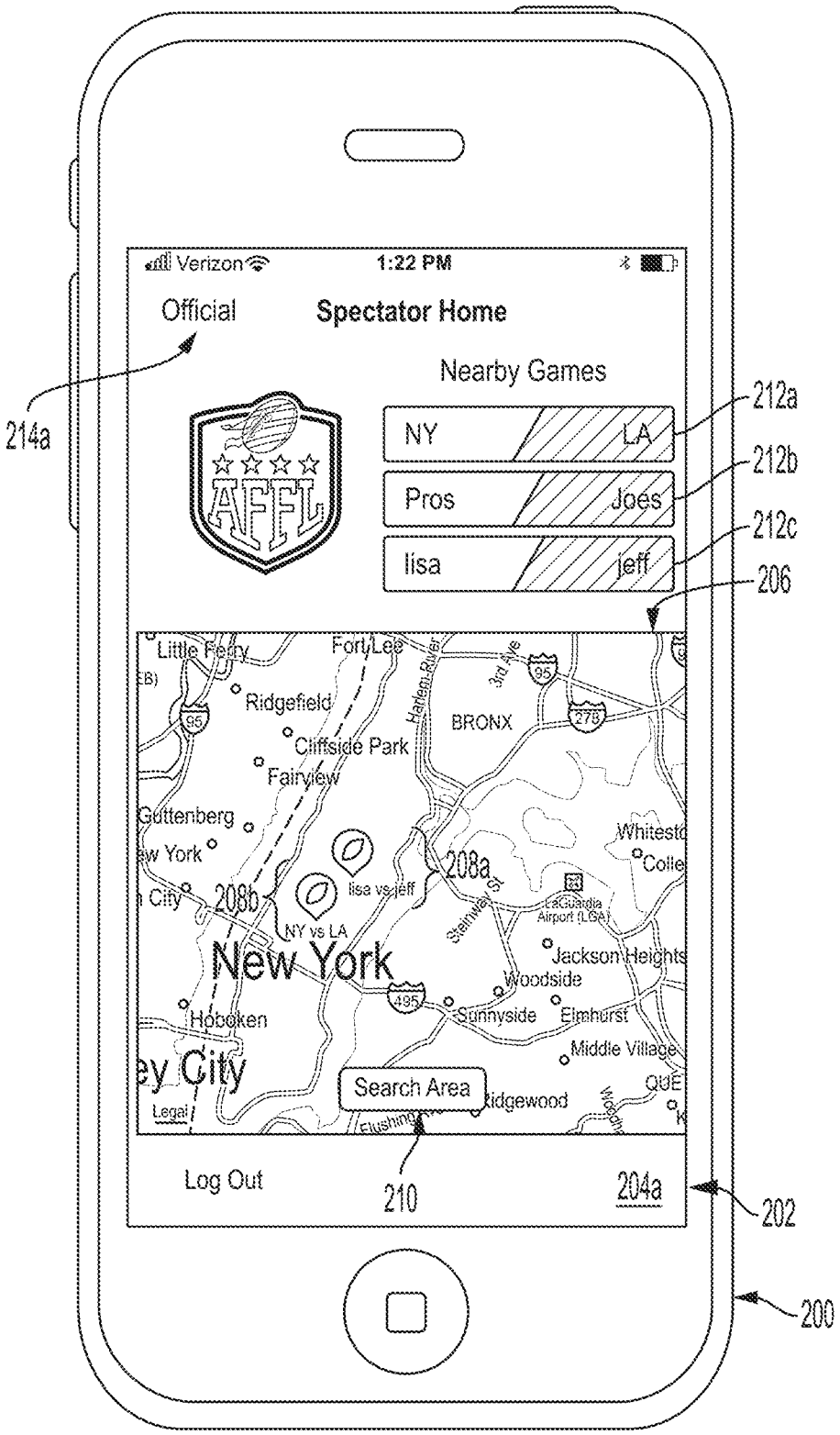
FIGS. 2A-2O show various graphical user interfaces for inputting, controlling, and displaying information about flag football games, in accordance with some embodiments.

Attention is now directed to FIGS. 2A-2O.

FIGS. 2A-2O show various graphical user interfaces 204*a*-204*h* for inputting, controlling, and displaying information about flag football games, in accordance with some embodiments. As shown in FIGS. 2A-2O, interfaces 204*a*-204*h* may be displayed by electronic device 200, which may in some embodiments be device 104 and/or device 112 of system 100. Interfaces 204*a*-204*o*, in some embodiments, enable users of device 200 to interact with one or more other components of an electronic flag football system, such as system 100 described above with reference to FIG. 1. Sending and receiving information about a flag football game using interfaces 204*a*-204*o* may allow users to send and receive accurate, real-time information about the scoring and officiating of an ongoing flag football game, including score information, statistics information, game-clock information, play-clock information, go-clock information, and/or throw-clock information.

Interfaces 204*a*-204*o* may be displayed via display 202, which may in some embodiments be a touch-screen display configured to display the interfaces and to receive touch inputs from a user of device 200. In some embodiments, device 200 may be a mobile electronic device such as a smart-phone or tablet. In some embodiments, device 200 may be a laptop computer, desktop computer, or other electronic computing device configured to display one or more of interfaces 204*a*-204*o* and to receive one or more inputs from a user, as discussed herein, to control operation of the interface and operation of a flag football system such as system 100. While the exemplary embodiments shown and discussed herein depict devices that may receive touch inputs from users on a touch screen such as display 202, alternate embodiments may be configured to receive input from a user using one or more other input devices alternately or additionally to a touch-screen display, such as a mouse, keyboard, one or more physical buttons or keys, voice command, etc.

Below, interfaces 204*a*-204*o* are discussed with respect to FIGS. 2A-2O in greater detail. Interfaces 204*a*-204*o* may, in some embodiments, be interrelated interfaces of a single program or application configured to be used in connection with one another. For example, each of the interfaces 204*a*-204*o* may be different screens that are selectively accessible from a mobile application or other computer program configured to work in conjunction with one or more electronic devices, including mobile electronic devices and/or dedicated electronic flag football equipment, in order to facilitate a flag football game. In some embodiments, interfaces 204*a*-204*o* may be part of a mobile application that can be downloaded and deployed by officials, coaches, players, scorekeepers, statisticians, and spectators of an ongoing flag football game, such that everyone who has joined the same flag football game may have access to coordinated and synchronized shared information about the game, including scoring information, statistics information, clock information, and the like. As discussed below, the interfaces 204*a*-204*o* may be configured to be used by spectators, officials, players, coaches, scorekeepers, statisticians, or any combination thereof.

FIG. 2A shows spectator home interface 204*a*, in accordance with some embodiments. Spectator home interface 204*a* may, in some embodiments, be an interface configured to allow flag football spectators to find flag football games (whether currently ongoing or planned for a future time), view the geographic location of ongoing or planned flag football games, view basic information (e.g., team names) about ongoing or planned flag football games, and select an ongoing or planned flag football game for which to view additional information (such as by "joining" the game and viewing information via spectator game interface 204*b*, as discussed in further detail below with respect to FIG. 2B). Thus, spectator home interface 204*a* may allow flag football spectators to browse potential games and select a game to join, such that the spectator may then view additional, live, real-time information about the selected game, as discussed in further detail below.

As shown in FIG. 2A, spectator home interface 204*a* may comprise map 206, which may be a graphical display of a geographic map. The map may show an area in the vicinity of a user of device 200, or may show an area determined in accordance with a predefined setting or a manual user selection. In the example in FIG. 2A, map 206 shows an area of New York city. In some embodiments, a user may be able to pan or zoon map 206 to show different geographic areas.

In some embodiments, map 206 may comprise one or more location markers indicating the location of ongoing and/or future flag football games (and/or, in some embodiments, past flag football games), such as game location markers 208*a* and 208*b*. Game location markers 208*a* and 208*b* appear visually on map 206 and indicate that a flag football game is or will be located at the geographic location corresponding to the location of the respective location marker. As shown, each location marker on the map indicates a geographic location on the map and shows the names of teams, captains, or players who are competing against one another in the game (e.g., "NY vs. LA" and "lisa vs. jeff"). Users of interface 204*a* may use map 206 and location markers 208*a* and 208*b* to locate games nearby a current location of the user.

In some embodiments, map 206 may further comprise search area icon 210, which may be a selectable icon that, upon being tapped or pressed by a user, causes the system to search for available games in the area displayed on map 206. Thus, a user may in some embodiments zoom and/or pan map 206 and then refresh the search by tapping search area icon 210 in order to display games available in the area of the map that is displayed after zooming and/or panning map 206. In some embodiments, selecting search area icon 210 to refresh the search may update the displayed location markers (e.g., marker 208*a* and 208*b* on map 206), and in some embodiments it may also update the displayed list of nearby games, as discussed below.

In addition to location markers 208*a* and 208*b* on map 206, interface 204*a* further comprises a list of nearby games shown by icons 212*a*-212*b*. As shown, icons 212*a*-212*b* may show the names of teams, captains, or players playing in the corresponding game, and in some embodiments may show additional information about the corresponding game. In some embodiments, the list of icons 212 may represent one or more of the same games that are shown by the location markers 208 on map 206. In some embodiments, the list of nearby games may be configured to show the games that are geographically nearest to a user (e.g., as determined by comparing a stored indication of a geographic location of a game to a geographic location of a user's device, such as device a GPS location of 200). In some embodiments, a predefined number of nearby games may be shown in the list; in some embodiments the list may be scrollable to see games that are progressively geographically further away.

In some embodiments, location markers 208*a* and 208*b* and/or icons 212*a*-212*b* may be interactive affordances, in that they may be clicked, tapped, pressed, or otherwise selected in order to activate a functionality of the graphical user interface. (As used herein, the term "icon" may also be used to refer to a selectable, interactive affordance in a graphical user interface.) In the case of location markers 208*a* and 208*b* and/or icons 212*a*-212*b*, a user may in some embodiments tap on one of the markers in order to "join" the game. In some embodiments, joining a specific game may cause a user's device to display an in-game interface (e.g., interface 204*b* or 204*d*, as discussed below). In some embodiments, joining a specific game may cause a user to be added to a list or roster of officials, players, coaches, spectators, or participants in a game; in some embodiments, lists of officials, players, coaches, spectators, or participants in a game may be visible to other users who have joined the same game using their own electronic devices.

In some embodiments, users may be permitted to join games only if they are within a predetermined geographic proximity of the location of the game (e.g., as defined by an official or by a creator of the game). In some embodiments, interface 204*a* may be configured such that users are only permitted to view and/or join nearby games. In some embodiments, a geographic location of a user may be determined in accordance with a GPS service of device 200, and the location of device 200 may be compared to the location of an available game to determine whether a user is sufficiently proximate to view and/or join the game. In some embodiments, a proximity threshold may be set to 100 feet, 500 feet, 1000 feet, 0.5 miles, 1 mile, or 5 miles.

In some embodiments, users may be permitted to view geographically distant games in interface 204*a* (e.g., in the list of nearby games 212*a*-212*c* and/or on map 206), but may only be permitted to join geographically proximate games. In some embodiments, different rules regarding geographic proximity may be applied to officials versus other game participants; for example, officials may be required to be geographically proximate to a game in order to join it (as they would need to be at the game itself in order to officiate it), while spectator may be able to join a game even if they are remotely geographically located (such that a spectator could follow along with scoring of a game from afar). In some alternate embodiments, users may be permitted to join games without regard to whether they are geographically proximate to the game.

In some embodiments, interface 204*a* additionally comprises mode switch icon 214*a*. This icon may be selectable by a user to cause the system to switch modes and to display an interface corresponding to a different mode than the current mode. In the example shown in FIG. 2A, interface 204*a* is an interface from a "spectator" mode configured to be used by game spectators (and in some embodiments by players and/or coaches); by tapping icon 214*a*, the system may cease to display interface 204*a* and may instead display an interface from an "official" mode configured to be used by game officials. Various official mode interfaces will be discussed below in more detail.

Figure 2B:
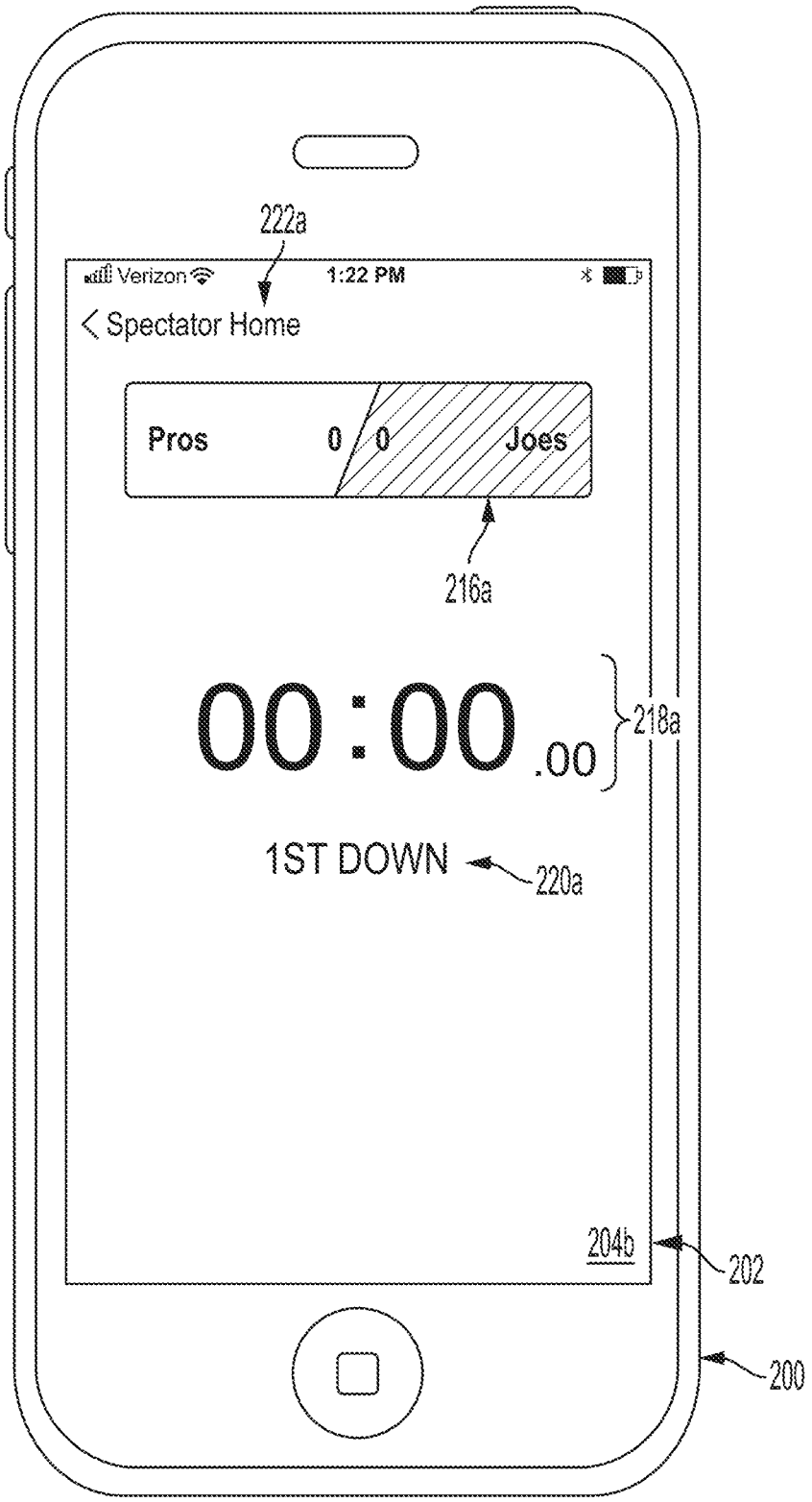

FIG. 2B shows spectator game interface 204*b*, in accordance with some embodiments. In the example of FIG. 2B, interface 204*b* corresponds to a game between a first team "Pros" and a second team "Joes." In some embodiments, the system may be caused to display interface 204*b* in response to a user joining the Pros vs. Joes game by clicking or tapping on an icon corresponding to the Pros vs. Joes game in interface 204*a* (e.g., a user tapping on icon 212*b*). That is, when a user selects a certain game by tapping the corresponding icon at interface 204*a*, the user's device (e.g., device 200) may send a signal through an associated network (e.g., network 102) in order to retrieve information about the game, such as from a remote server on which the some or all of the game information is centrally maintained (e.g., server 114). Information about the game may then be sent, responsively, via the network, to the requesting user's device, such that the information about the game may be displayed as part of interface 204*b*. In some embodiments, spectator game interface 204*b* may be configured to display basic information about an ongoing (or past) game, such that a game spectator (or player or coach) can have instant access to real-time game information that is coordinated with the controlling official's information, in some embodiments including game clock information, play clock information, and/or go-clock/throw-clock information.

As shown in FIG. 2B, interface 204*b* may comprise score information 216*a*, game clock information 218*a*, and down information 220*a*, each of which may be a visible graphical user interface object configured to display certain information about the game.

In some embodiments, score information 216*a* may display the names of the teams and the current score or the game (if it is ongoing) or the final score of the game (if it has not yet begun). In the example shown in FIG. 2B, score information 216*a* shows that both the Pros team and the Joes team have 0 points.

In some embodiments, game clock information 218*a* may display an amount of time remaining on a game clock (whether in a current quarter, a current half, or the entire game). In some embodiments, game clock information 218*a* may display a current quarter or a current half of the game (e.g., "first half," or "third quarter") along with the time remaining in the current quarter or current half. In the example shown in FIG. 2B, score information 216*a* shows that no time is remaining in the quarter, half, or game.

In some embodiments, down information 220*a* may display the current down in the game (e.g., whether it is $1^{st}$ down, $2^{nd}$ down, $3^{rd}$ down, or $4^{th}$ down). In the example shown in FIG. 2B, down information 220*a* shows that it is currently first down.

Interface 204*b* may further comprise interface return icon 222*a*, which may be a selectable icon that a user may tap, click, or press in order to cause the system to cease to display spectator game interface 204*b* and to return to display of spectator home interface 204*a*. In some embodiments, when device 200 detects that a user has selected (e.g., tapped, pressed, clicked) icon 222*a*, device 200 may send a signal to remote server 114 requesting data necessary to render and display interface 204*a*, and the requested data may be sent from remote server 114 to device 200 such that device 200 may display interface 204*a* for the user.

Figure 2C:
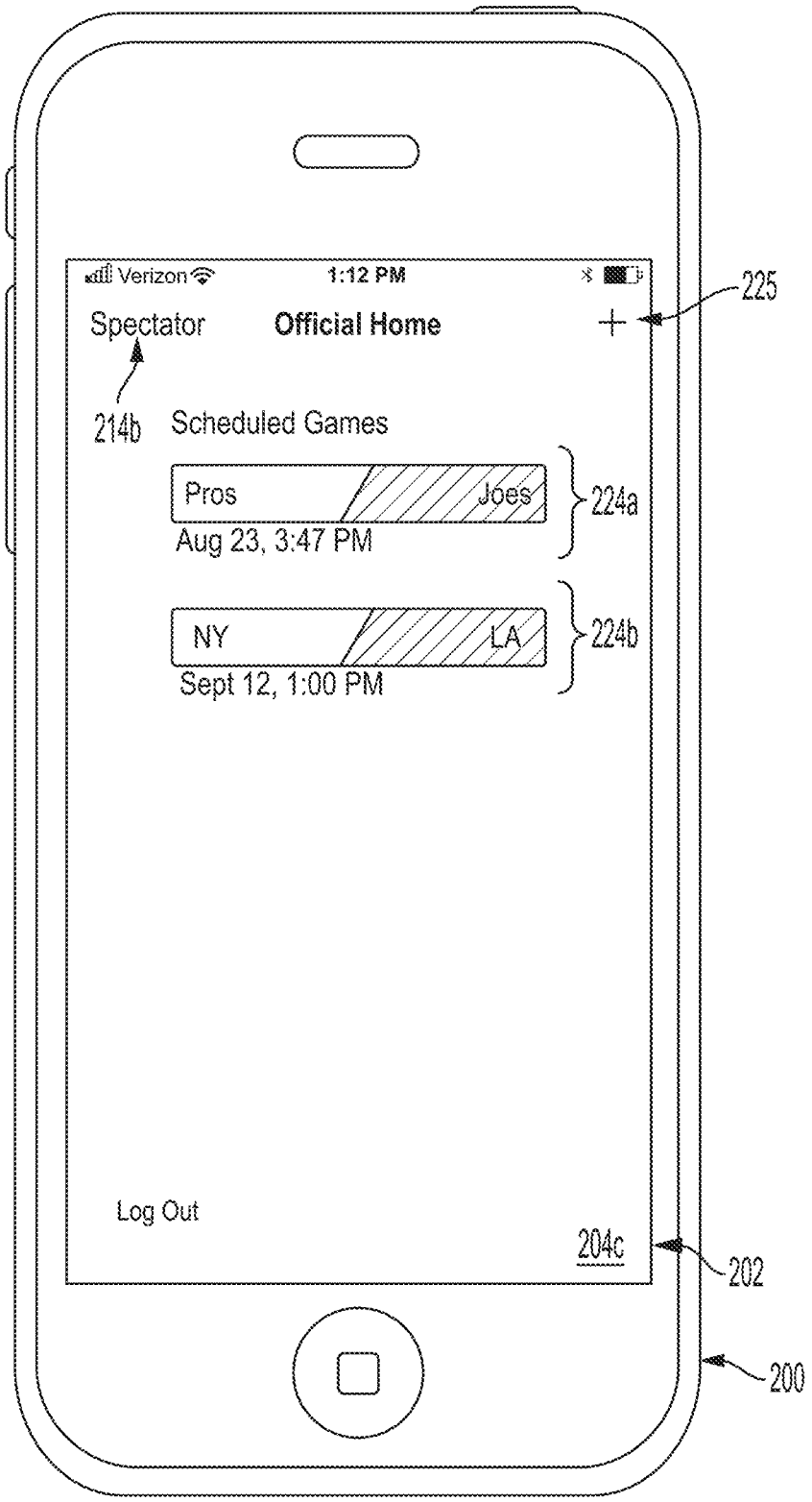

FIG. 2C shows official home interface 204*c*, in accordance with some embodiments. Interface 204*c* may be accessed, in some embodiments, by selecting mode switch icon 214*a* in interface 204*a*. When a user selects mode switch icon 214*a* in interface 204*a*, the system may cause the user's device (e.g., device 200) to switch from spectator mode to official mode, and a default official interface screen such as interface 204*c* may be displayed. In some embodiments, an official home interface such as interface 204*c* may be configured to display information about any games which an official is permitted to join, such as games that the official is located geographically proximate to, and/or games for which the official has been designated to officiate beforehand. For example, an official may be identified by a unique user-identifier that he or she may use to log into the system, and the system may then display any games for which that official is designated to officiate on interface 204*c*. In some embodiments, a game creator or system administrator may designate one or more officials (e.g., one or more users identified by unique user identifiers) who are permitted to officiate the game.

As shown in the FIG. 2C, interface 204*c* may comprise scheduled a list of scheduled games including scheduled game icons 224*a* and 224*b*. In some embodiments, any number of scheduled games may be represented by respective icons in the list of scheduled games; in some embodiments, the list may be scrollable. In the example of FIG. 2C, the list of scheduled games comprises two scheduled games, Pros vs. Joes and NY vs. LA.

As shown by icons 224*a* and 224*b*, a scheduled game icon may display basic information about the scheduled game, such as team names and colors, game date, game time, and/or game location. In some embodiments, scheduled game icons 224*a* and 2244*b* may share any one or more characteristics in common with nearby game icons 212*a*-212*c* discussed above with reference to FIG. 2A, including that scheduled game icons 224*a* and 2244*b* may be selectable affordances that may be tapped, pressed, or clicked by a user in order to cause the system to display an interface corresponding to the selected specific game, such as interface 204*d* discussed below.

Interface 204*c*, in some embodiments, further comprises add game icon 225, which may be a selectable icon or other user interface object that allows an official to access, via interface 204*c*, one or more other interfaces configured to allow the official to create a new flag football game to be added to the list of scheduled games, and such that the game may be visible to other users of the system (e.g., system 100) including other officials, coaches, players, and spectators. Interfaces for creating and publishing new games will be discussed below in greater detail with respect to FIGS. 2G and 2H.

Figure 2D:
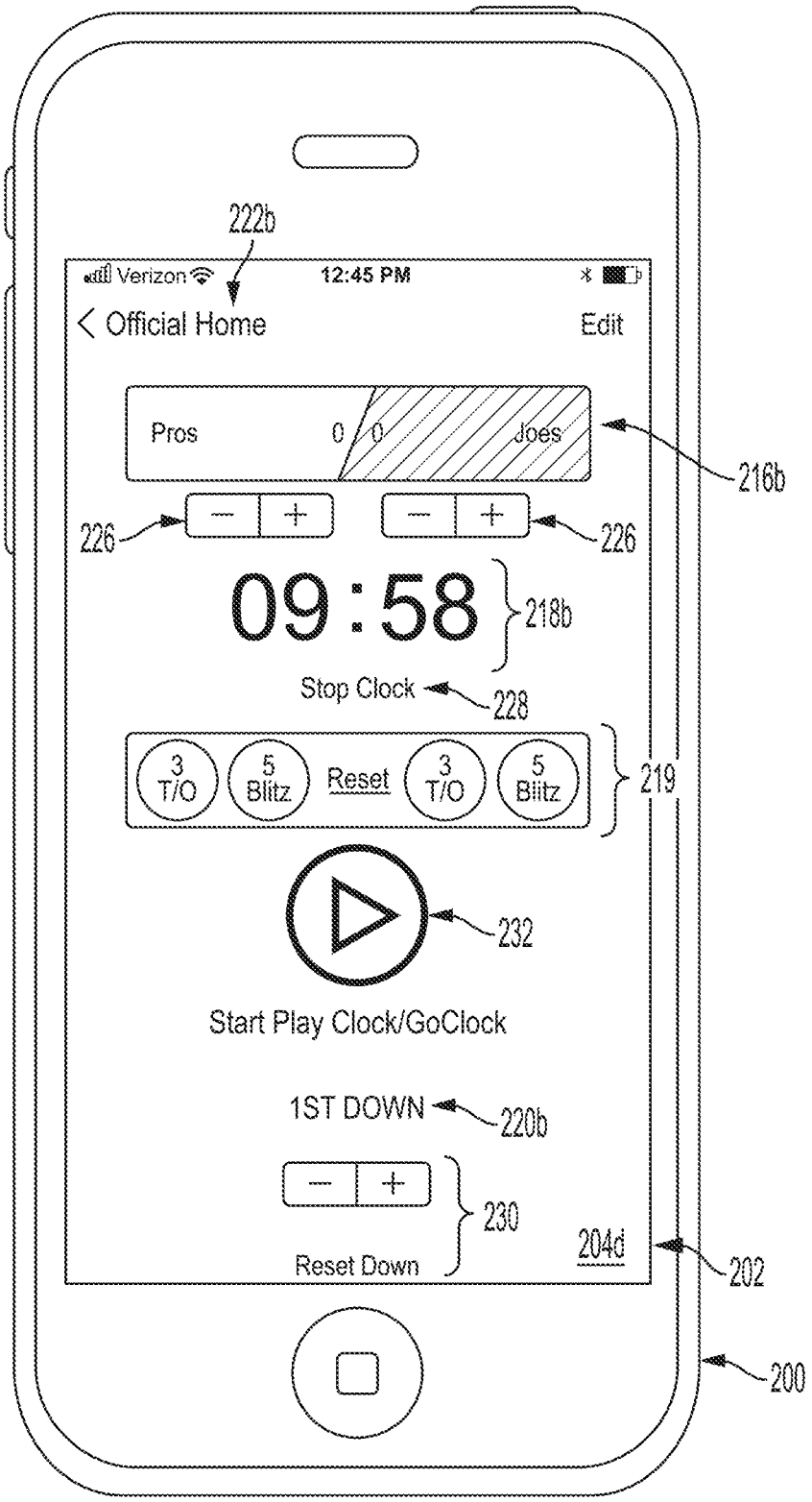

FIG. 2D shows official game interface 204*d*, in accordance with some embodiments. In the example of FIG. 2D, interface 204*d* corresponds to a game between a first team "Pros" and a second team "Joes." In some embodiments, the system may be caused to display interface 204*d* in response to a user selecting icon 224*a* in interface 204*c* as shown in FIG. 2C. That is, when an official using a device displaying an official home interface selects a certain game by tapping the corresponding icon at interface 204*c*, the official's device (e.g., device 200) may send a signal through an associated network (e.g., network 102) in order to retrieve information about the game, such as from a remote server on which the some or all of the game information is centrally maintained (e.g., server 114). Information about the game may then be sent, responsively, via the network, to the requesting official's device, such that the information about the game may be displayed as part of interface 204*d*.

In some embodiments, official game interface 204*b* may be configured to display information about an ongoing game, such that a game official can view the game information and control the game information in real-time for distribution to the mobile devices of one or more other officials, spectators, players or coaches who have joined the same game, and/or to other electronic equipment (e.g., smart flags, smart balls, sideline markers, and/or scoreboards) communicatively coupled in the system (e.g., system 100) to the controlling official's mobile device. In some embodiments, a game may be configured in the system such that only one official may access an official game interface to control and broadcast information about the game; in some embodiments, a game may be configured in the system such that more than one official may simultaneously access various official game interfaces on various electronic devices in order to collaboratively control and broadcast information about the game.

As shown in FIG. 2D, official game interface 204*d* may comprise score information 216*b*, game clock information 218*b*, and down information 220*b*, each of which may be a visible graphical user interface object configured to display certain information about the game. In some embodiments, score information 216*b*, game clock information 218*b*, and down information 220*b* may share any one or more characteristics in common with score information 216*a*, game clock information 218*a*, and down information 220*a*, respectively, descried above with respect to FIG. 2B. That is, just as information about the score, game clock, and down may be displayed on a spectator game interface such as interface 204*b*, information about the score, game clock, and down may also be displayed on an official game interface such as interface 204*d*.

In addition to graphical user interface objects configured to display current game information (e.g., score information 216*b*, game clock information 218*b*, and down information 220*b*), official game interface 204*d* may further comprise one or more graphical user interface objects configured to allow an official to control game information, such as by adjusting a score of the game, adjusting an amount of time on a game clock, and/or adjusting a down. As shown in FIG. 2D, official game interface 204*d* may comprise score control icons 226, clock control icons 228, and down control icons 230. Each of these icons may be selectable graphical user interface objects that may be clicked, tapped, or pressed by the official using device 200 in order to adjust the score of the game by tapping an icon to increase or decrease the score of a team, to start or stop the game clock, to adjust the game clock (e.g., by entering a new game clock time into a field or by adding or subtracting seconds by tapping an icon to do so), and/or to adjust the current down by tapping an icon to add or subtract to the down or by tapping an icon to reset the down.

In some embodiments, when an official adjusts information (e.g., score, clock, or down information) about a game, a signal may be sent from the official's device (e.g., device 200) to other electronic devices in the system, such as by being sent directly to other electronic devices in the system or by being sent to a remote server (e.g., server 114) to be stored and/or distributed to other electronic devices in the system and associated with the game. In this way, an official may make changes to game information and the changes may be immediately broadcast for consumption by/or display on other electronic devices in the system and associated with the game. In some embodiments, spectators, players, and/or coaches may thereby have access to real-time updated information about the ongoing game.

Interface 204*d* may further comprise one or more graphical user interface objects for displaying and/or facilitating control of a number of remaining timeouts for one or more teams, a number of remaining blitzes for one or more teams (e.g., in flag football game formats in which teams are limited in the number of blitzes that they may execute per game), or both. In the example of FIG. 2D, interface 204*d* comprises timeout and blitz control icons 219. As shown, timeout and blitz control icons may be provided as a plurality of icons for displaying a remaining number or timeout for a team or a remaining number of blitzes for a team. An official may cause the displayed remaining number to change (e.g., count down by one) by tapping the icon on the interface; in some embodiments, the displayed remaining number may cycle back to a maximum number (e.g., a starting number for a quarter, half, or game) after displaying zero remaining timeouts or blitzes. In some embodiments, control icons 219 may be provided alongside one or more reset icons, which may be configured to automatically reset the remaining number of timeouts and/or blitzes to a maximum starting number, without the need to cycle down to and past zero. In some embodiment, one or more reset icons may be used by an official, for example, at the end of a half, when the remaining number of timeouts and/or blitzes for a team may reset.

Interface 204*d* may further comprise interface return icon 222*b*, which may be a selectable icon that a user may tap, click, or press in order to cause the system to cease to display official game interface 204*d* and to return to display of official home interface 204*c*. In some embodiments, when device 200 detects that a user has selected (e.g., tapped, pressed, clicked) icon 222*b*, device 200 may send a signal to remote server 114 requesting data necessary to render and display interface 204*c*, and the requested data may be sent from remote server 114 to device 200 such that device 200 may display interface 204*c* for the user.

Interface 204*d* may further comprise play clock control icon 232, which may be a selectable icon that a user may tap, click, or press in order to cause the device (e.g., device 200) and/or system (e.g., system 100) to start or stop a play clock, go-clock, and/or throw clock. As discussed above, operating a play clock, go-clock, and/or throw clock in a flag football game may be challenging or infeasible in an environment that does not have access to stadium-integrated scoreboard technology, such as a pickup-game environment. Accordingly, use of the interfaces described herein may allow for effective, accurate, and intuitive operation of a play clock, go-clock, and/or throw clock in such an environment, in that a game official may be able to operate a the play clock, go-clock, and/or throw clock from a mobile electronic device (e.g., a handheld mobile electronic device, such as device 200 or the like).

In some embodiments, a play clock, go-clock, and/or throw clock may be operated solely locally on an official's mobile electronic device (e.g., device 200), such that only the controlling official may be able to view and/or control the play clock, go-clock, and/or throw clock. In some such embodiments, the controlling official may be responsible for verbally announcing or otherwise signaling the expiration of one or more of the clocks to other participants and spectators.

In some embodiments, one or more components of the system (e.g., system 100) may be configured to automatically notify other participants and spectators regarding the play clock, go-clock, and/or throw clock information. For example, in some embodiments, the official's electronic device (e.g., device 200) may send one or more electronic signals to other electronic devices in the system, such as mobile electronic devices of other officials, spectators, players, and/or spectators; scoreboards, electronic sideline markers, wearable devices such as smart flags or belts, and/or smart footballs. A signal may be sent from the device directly manually controlled by the official (e.g., device 200) directly to other electronic devices associated with the game, and/or a signal may be sent through one or more intermediary electronic devices, such as being sent through network 102 of system 100. In any event, the system may cause the various electronic devices associated with the game to synchronize display of one or more play-clocks, go-clocks, and/or throw-clocks on the various devices with the clock information entered and controlled by the controlling official on the controlling official's device. Thus, when the official starts, stops, pauses, or resets a play clock, go-clock, and/or throw clock on his own device, the associated clocks displayed on associated electronic devices may be caused to start, stop, pause, or reset in real-time coordination with the official's device.

Alternately or additionally to causing associated electronic devices to display a play clock, go-clock, and/or throw clock in real-time coordination with the official's device, the system may in some embodiments cause one or more devices in the system to generate an output indicating the expiration of a play clock, go-clock, and/or throw clock. The output generated may be a visual indicator (e.g., displayed information on a display, illuminating one or more lights or LED's, etc.), an audible indicator (e.g., a sound emitted from a speaker), a haptic indicator (e.g., a vibration of a device), or an electronic signal generated and/or stored by one of the devices. For example, in some embodiments, the official's electronic device (e.g., device 200) may be caused to emit an audible signal when a play-clock expires, such that the official may be alerted to the expiration of the play-clock without being required to look away from the players in the game. The same or similar functionality may be enabled with respect to a go-clock and/or throw-clock; in some embodiments, a different audible indicator (e.g., different numbers of tones) may be generated in accordance with the expiration of different kinds of clocks. In some embodiments, audible indicators of play-clock, go-clock, and/or throw-clock expirations may be emitted by one or more wearable devices (e.g., electronic flags and/or belts) worn by players, such that players may have an audible indication of the clock expiration without needing to avert their eyes from other players in the game.

As shown in the example of FIG. 2D, an official may control a play-clock and/or go-clock using a play-clock control icon such as play-clock control icon 232, which may be a selectable icon that a user may tap, click, or press in order to cause the device (e.g., device 200) and/or system (e.g., system 100) to start or stop a play clock, go-clock, and/or throw clock. When an official taps, clicks, or presses icon 232, device 200 may cease to display interface 204*d* and may then display interface 204*e*, as shown in FIG. 2E.

Figure 2E:
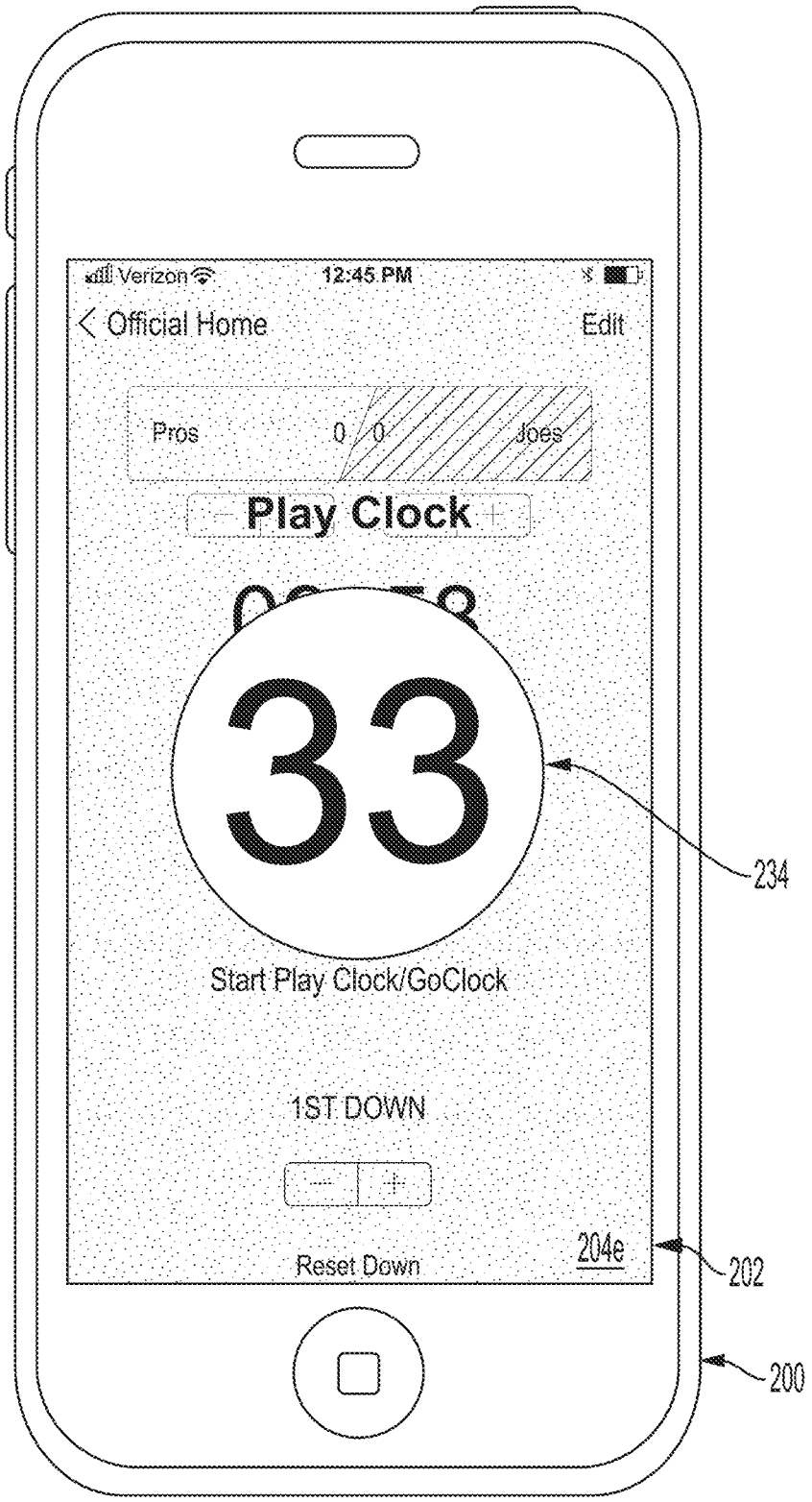

FIG. 2E shows official game interface 204*e*, in accordance with some embodiments. Official game interface 204*e* is similar to official game interface 204*d*, except that interface 204*e* includes an overlay showing a play-clock. In some embodiments, after an official taps icon 232 in interface 204*d*, the play-clock overlay shown in interface 204*e* may appear, and may persist until the expiration of the play-clock or until a user of the system (e.g., the official using device 200) executes another command to cause the overlay to cease to be displayed. As shown in FIG. 2E, the play-clock overlay may include play-clock information 234, which may show a count-down timer indicating the number of seconds remaining on the play-clock in real time.

In some embodiments, if play-clock information is distributed to other electronic devices in the system (e.g., system 100), then a similar overlay and/or similar play-clock information user interface object may be shown on other electronic devices, such as on a spectator's mobile electronic device in spectator mode.

In some embodiments, interface 204*e* may be displayed until the play-clock expires (e.g., reaches zero if counting down, or reaches a predefined non-zero number of seconds if counting up) or until a controlling official executes an input (e.g., tapping interface 204*e*, including tapping a dedicated user interface object displayed thereon) that indicates that the ball has been snapped or that display of the play-clock is no longer required. In some embodiments, the play-clock overlay may continue to be displayed after the play-clock expires (e.g., it may continue to display "0" seconds remaining until cleared by an official).

In some embodiments, the system may advance from the play-clock overlay to a go-clock overlay upon the snap of the ball. In some embodiments, the play-clock overlay (or other play-clock indicator) may cease to be displayed and a go-clock overlay may (or other go-clock indicator) may be displayed in its place upon the ball being snapped. In some embodiments, the system may determine that the ball has been snapped in accordance with detecting an input entered by the controlling official, such as detecting the controlling official tapping or touching the display of device 200, or tapping or touching a specific interface icon of device 200, while interface 204*e* is displayed. In some embodiments, the system may determine that the ball has been snapped in accordance with detecting movement and/or acceleration of a smart football that is associated with the game being played and is communicatively coupled to other electronic devices in the system.

Figure 2F:
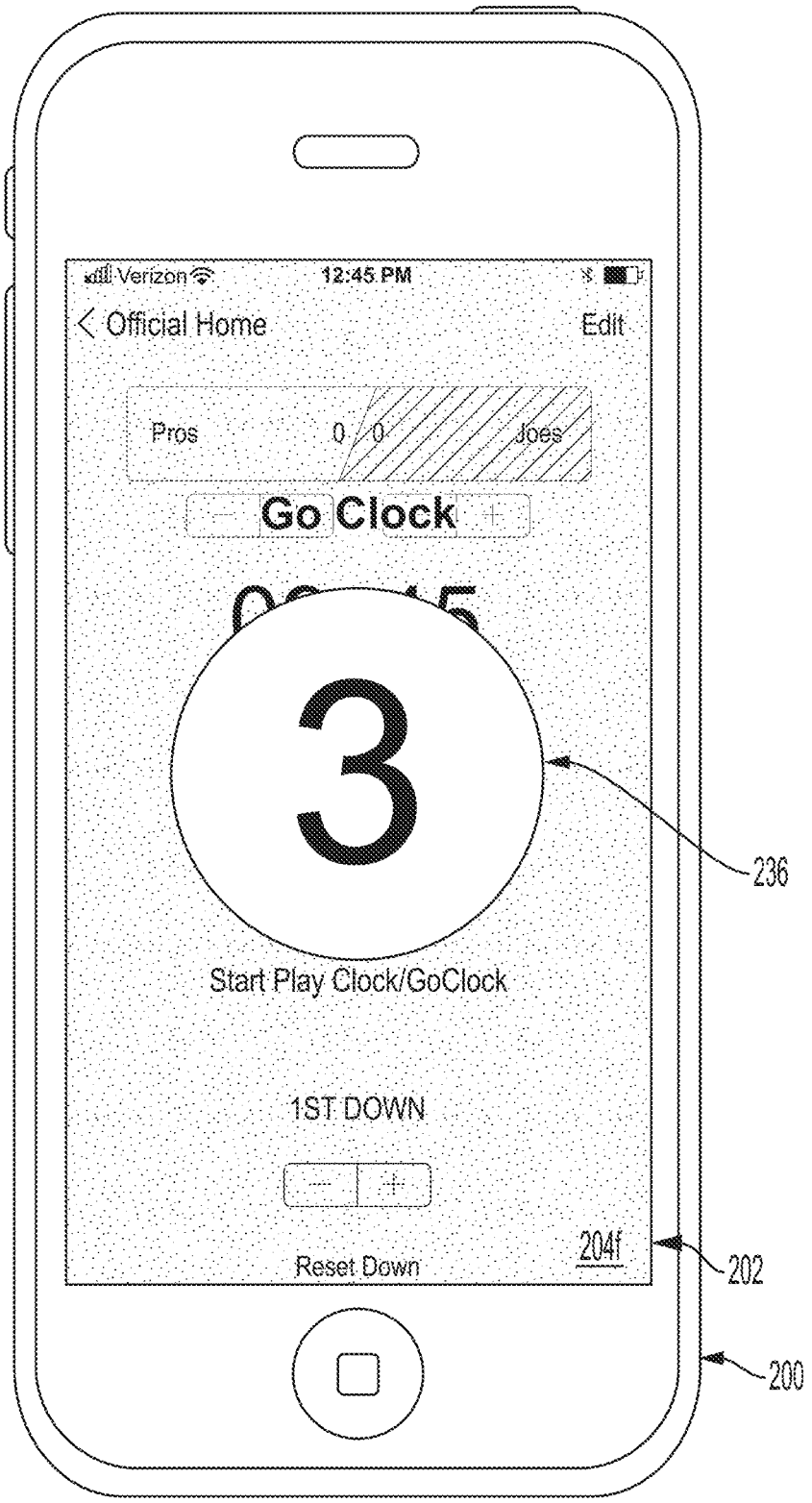

Upon detecting that the ball has been snapped, interface 204*e* may be replaced with interface 204*f* shown in FIG. 2F.

FIG. 2F shows official game interface 204*f*, in accordance with some embodiments. Official game interface 204*f* is similar to official game interface 204*e*, except that interface 204*f* includes a go-clock interface including go-clock information 236, rather than a play-clock overlay including play-clock information 234. In some embodiments, interface 204*f* may function in a same or similar manner to interface 204*e*, including in the manner that it displays information, accepts inputs from the controlling official controlling the device, and causes the device to distribute clock information for display on associated devices and/or generation of audible or visual indicators, except that the interface may display go-clock information rather than play-clock information. As discussed above, interface 204*f* may be displayed, in some embodiments, following the system detecting that a ball has been snapped, as display of a play-clock is no longer necessary and display of a go-clock is now required for officiating the game.

In some embodiments, interface 204*f* may be displayed until the go-clock expires (e.g., reaches zero if counting down, or reaches a predefined non-zero number of seconds if counting up) or until a controlling official executes an input (e.g., tapping interface 204*f*, including tapping a dedicated user interface object displayed thereon) that indicates that the play has ended or that display of the go-clock is no longer required. In some embodiments, the go-clock overlay may continue to be displayed after the go-clock expires.

As discussed above, in some embodiments, an audible tone may be caused to be emitted from the electronic device of the controlling official (e.g., device 200) and/or from associated electronic devices upon expiration of the go-clock, such that players may be audibly notified that rushing the quarterback is permitted.

In some embodiments, after expiration of the go-clock, a throw-clock may then be displayed (in games in which a throw-clock is utilized). A throw-clock interface may be similar to interfaces 204*e* and 204*f*, except that throw-clock information may be displayed in the place of play-clock information or go-clock information. In some embodiments, after expiration of the go-clock, the play-clock/go-clock overlays may cease to be displayed and the device (e.g., device 200) may return to display of a default official game interface, such as interface 204*d* discussed above with respect to FIG. 2D.

In some embodiments, after expiration of the go-clock (or after expiration of a throw-clock), an expiration screen may be displayed; for example, an expiration screen may comprise a graphical indicator such as an "X." In some embodiments, an official may clear an expiration screen by executing an input (e.g., tapping the expiration screen, or tapping a dedicated user interface object displayed thereon).

Figure 2G:
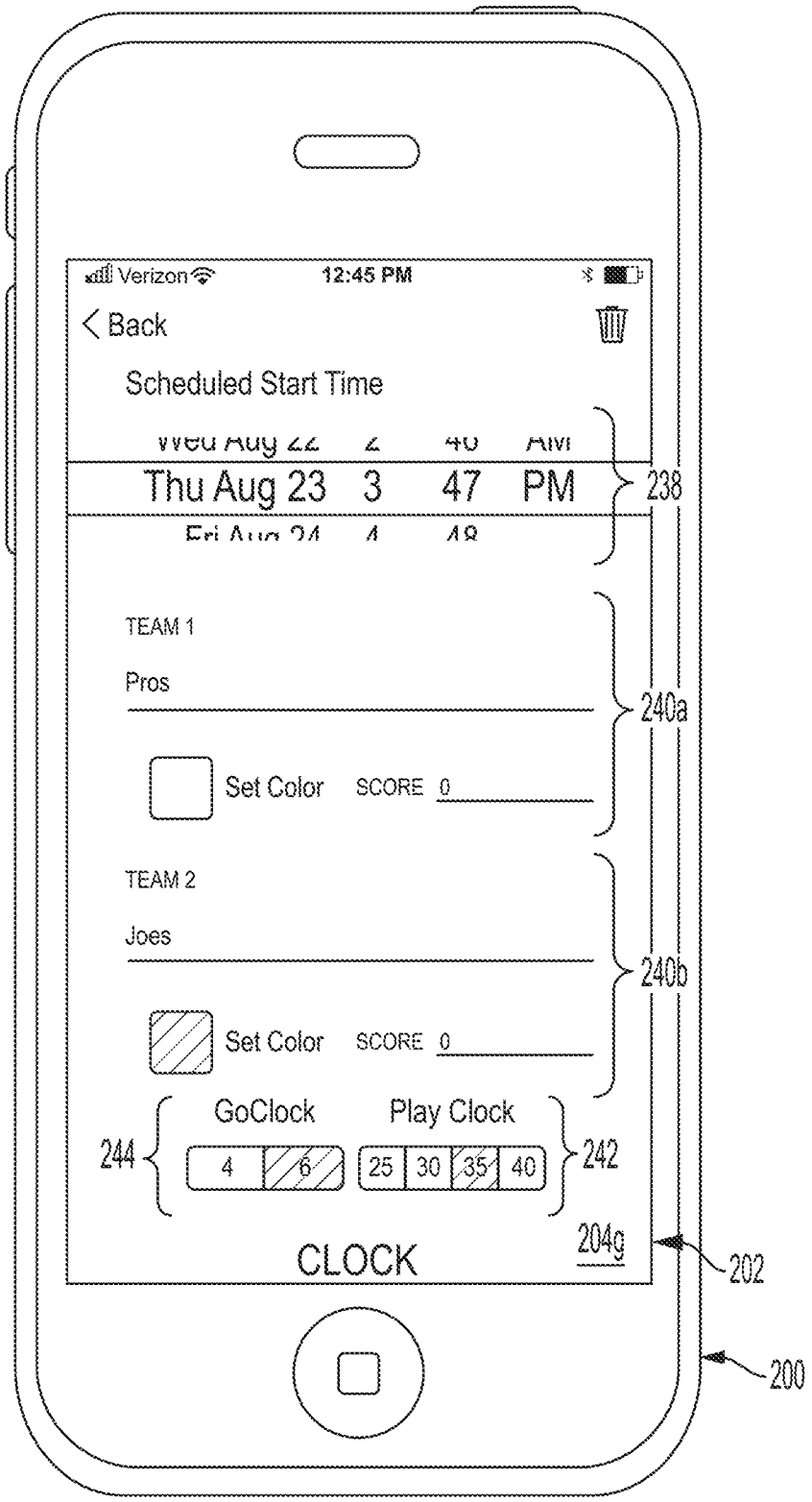
Figure 2H:
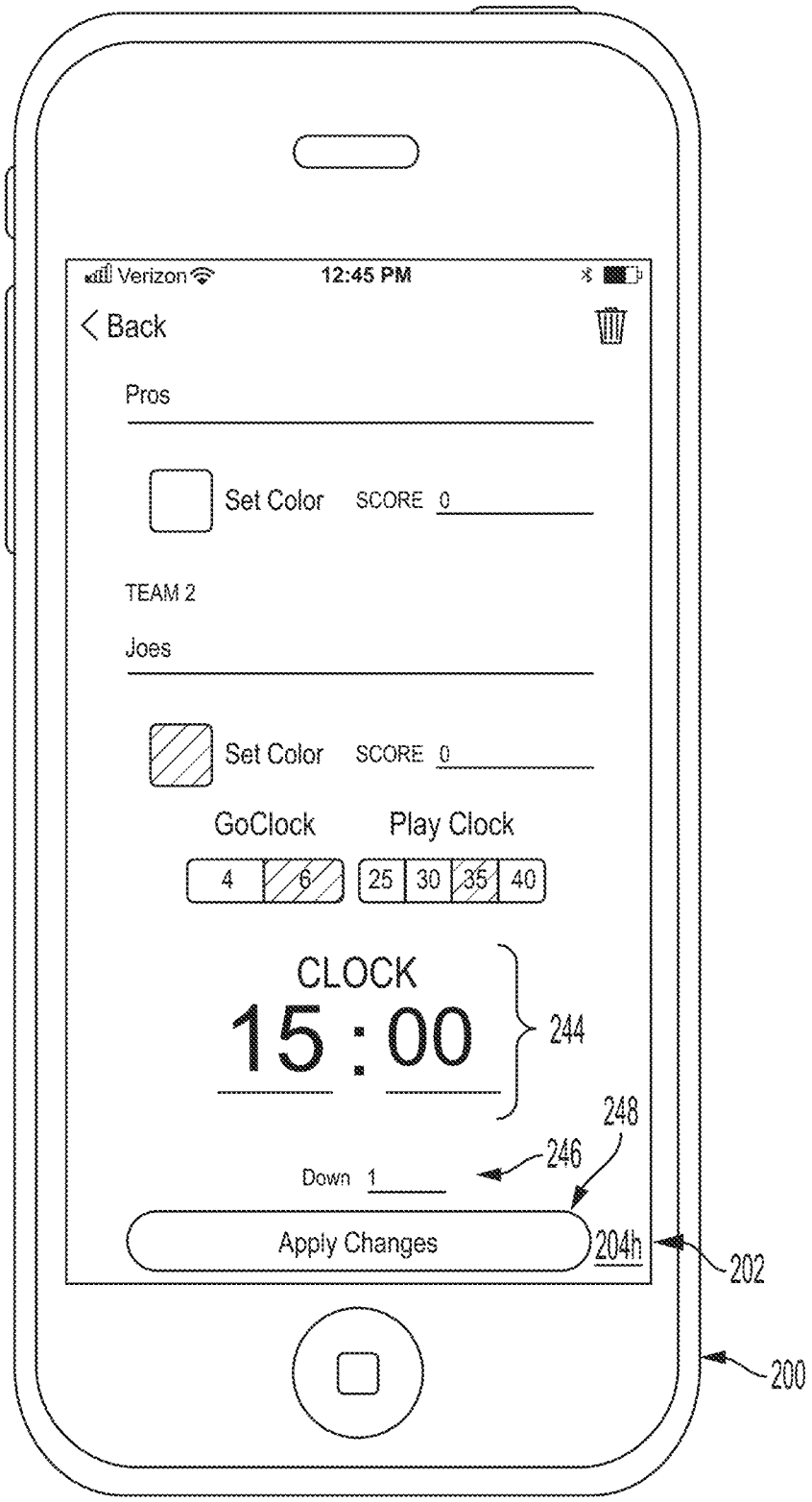

FIGS. 2G and 2H show game setup interfaces 204*g* and 204*h*, in accordance with some embodiments. In the example shown, interface 204*h* is a scrolled-down version of interface 204*g*. Interfaces 204*g* and 204*h* are interfaces that may be used to enter information about a flag football game by the creator of the game, such that information about the game may be stored by the system (e.g., system 100) and published to be visible by other users of the system, including officials, players, coaches, and spectators.

In some embodiments, only officials may be permitted to create new games, using an official mode of the system as discussed herein; while in some embodiments players and coaches may also be able to create new games, and in some embodiments may be able to do so from a spectator mode of the system.

In some embodiments, interfaces 204*g* and 204*h* may be accessed by selecting (e.g., tapping, pressing, clicking) add game icon 225 in official home interface 204*c*, as discussed above with respect to FIG. 2C.

As shown in FIGS. 2G and 2H, interfaces 204*g* and 204*h* may comprise various fields, interfaces, and other user interface objects configured to allow a user to enter information about a game to be created, such as the team names, team colors, game time, game location, play-clock settings, go-clock settings, throw-clock settings, game-clock settings, downs, and the like. User interface objects for entering this information may include selectable icons, fields into which a user may type, and/or user interface object allowing a user to select a date and time from a scrollable list of date and time options. In the example of FIGS. 2G and 2H, interfaces 204*g* and 204*h* comprise time selection interface 238, team information input interfaces 240*a* and 240*b*, play-clock settings interface 242, go-clock settings interface 244, game-clock information input interface 244, down information input interface 246, and apply changes icon 248.

Time selection interface 238 may be any one or more user interface objects configured to allow a user to input, select, or otherwise indicate information regarding a time and/or date of the game. In some embodiments, a user may type the information into a data field; in some embodiments, the user may select one or more options by clicking one or more icons. In the example shown in FIG. 2G, a user may swipe various scrollable user interface objects to select items from a list of available dates and/or times in order to indicate the date and/or time of the game.

Team information input interfaces 240*a* and 240*b* may each be any one or more user interface objects configured to allow a user to input, select, or otherwise indicate information regarding teams to play in a flag football game; the information may include team name, team color, team score (e.g., for past games), or any other information about the team that may be broadcast to other users of the system. In some embodiments, a user may type the information into a data field; in some embodiments, the user may select one or more options by clicking one or more icons. In the example shown in FIG. 2G, team information input interface 240*a* allows a user to input information associated with a first team, while team information input interface 240*b* allows a user to input information associated with a second team. In the example shown, a user may type a team name in a respective field, may click a team color icon to select a team color from a popup menu of colors, and may type a team score into a respective field.

Play-clock settings interface 242 may be any one or more user interface objects configured to allow a user to input, select, or otherwise indicate information regarding play clock settings to be used for a flag football game; the information may include whether a play clock is to be used, whether play clock information is to be broadcast to associated devices (and, in some embodiments, the identity of those devices), and/or how many seconds are to be on the play clock. In some embodiments, a user may type the information into a data field; in some embodiments, the user may select one or more options by clicking one or more icons. In the example shown in FIG. 2G, play-clock settings interface 242 allows a user to select one of four potential play-clock lengths by tapping one of four icons.

Go-clock settings interface 244 may be any one or more user interface objects configured to allow a user to input, select, or otherwise indicate information regarding go-clock settings to be used for a flag football game; the information may include whether a go-clock is to be used, whether go-clock information is to be broadcast to associated devices (and, in some embodiments, the identity of those devices), and/or how many seconds are to be on the go-clock. In some embodiments, a user may type the information into a data field; in some embodiments, the user may select one or more options by clicking one or more icons. In the example shown in FIG. 2G, play-clock settings interface 242 allows a user to select one of two potential go-clock lengths by tapping one of two icons.

Game-clock information input interface 244 may be any one or more user interface objects configured to allow a user to input, select, or otherwise indicate information regarding game-clock settings to be used for a flag football game; the information may include whether a game-clock is to be used, whether game-clock information is to be broadcast to associated devices (and, in some embodiments, the identity of those devices), and/or how many minutes and/or seconds are to be on the game-clock. In some embodiments, a user may type the information into a data field; in some embodiments, the user may select one or more options by clicking one or more icons. In the example shown in FIG. 2G, play-clock settings interface 242 allows a user to type an amount of time for a game-clock into a field.

Down information input interface 246 may be any one or more user interface objects configured to allow a user to input, select, or otherwise indicate information regarding down settings to be used for a flag football game; the information may include a number of downs to be used in the game (e.g., 2-down football, 3-down football or 4-down football). In some embodiments, a user may type the information into a data field; in some embodiments, the user may select one or more options by clicking one or more icons. In the example shown in FIG. 2G, down information input interface 246 allows a user to type a number of downs into a field.

Finally, apply changes icon 248 may be a selectable icon that causes the system (e.g., system 100) to transmit the information entered via the various user interface objects on interfaces 204*g* and 204*h* from the user's device (e.g., device 200) to one or more other elements of the system, that causes the system to store the information that has been entered, and/or that causes the system to make available and/or distribute the information that has been entered to other users of the system. After creating a game and/or applying changes when editing a game, the new game information may then be available to other users of the system, including, in some embodiments, appearing on game lists for other associated officials and/or appearing on game maps and/or lists for spectators, players, and/or coaches.

In some embodiments, interfaces 204*g* and/or 204*h* may additionally comprise one or more user interface objects for inputting information regarding the location of a future game. For example, a user may type an address for a game location in a field, or may select a game location on a map. In some embodiments, the system may automatically determine a location for a game being created as corresponding to (e.g., being the same location as) a GPS location detected by the device of the official creating the game.

In some embodiments, an official may access one or more interfaces that are the same or similar to interfaces 204*g* and 204*h* after a game has already been created, and the user may thereby edit information about the game. In some embodiments, information about a game may only be edited before the game has begun, while in some embodiments, information about the game may be edited while the game is ongoing (e.g., a game-clock may be reset, a score may be adjusted, a down may be changed, etc.). In some embodiments, after a user modifies information about an existing game, the information may be transmitted to other users of the system who have joined the game or who are associated with the game, and the information may also be broadcast to any electronic devices (e.g., sideline markers, scoreboards, and the like) associated with the game.

FIGS. 2I-2O show various interfaces 204*i*-204*o* for recording statistics (e.g., scorekeeping or stat-keeping) of a flag football game. Interfaces 204*i*-204*o* may, in some embodiments, be provided as part of a statistician mode, for example as distinct from an official mode or a spectator mode. In some embodiments, statistician mode may comprise a plurality of interface screens that may be displayed to a user (e.g., displayed on device 200); the statistician mode interfaces may in some embodiments be selected by a user by selecting graphical user interface elements to enter statistician mode in a same or similar way that a user may execute inputs to join a game in official mode or spectator mode. In some embodiments, a user may be able to join a flag football game as a registered statistician for the game, and statistics recorded by the user may be transmitted to the network and made available to be seen by one or more other users associated with the game. In some embodiments, a statistician mode of the system may be configured to enable user to track flag football statistics including but not limited to passing yardage statistics, rushing yardage statistics, receiving yardage statistics, receptions, passing attempts, completions, first downs, touchdowns, conversions, return yards, flag pulls, flag pulls for a loss, flag pulls for possession, safeties, sacks, and interceptions. Interfaces 204*i*-204*o* show exemplary (rather than exhaustive) scorekeeping interfaces and functionalities.

Figure 2I:
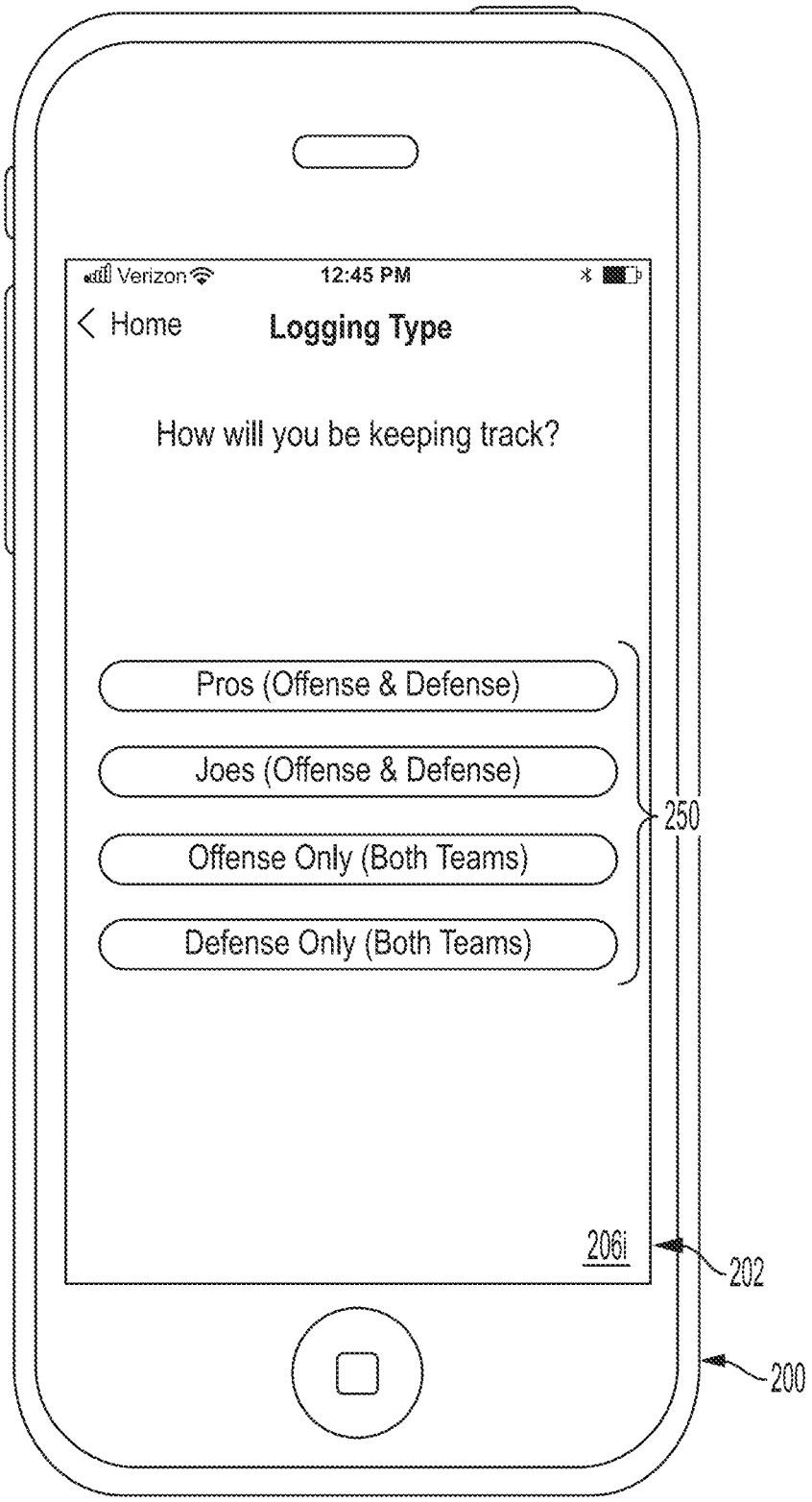

FIG. 2I shows interface 206*i*, which is a statistician game setup interface. As shown in FIG. 2I, interface 206*i* prompts the user to select a mode in which the user will be keeping track of statistics, providing several option icons 250. In the example shown, the four option icons 250 correspond to (1) keeping track of offensive and defensive statistics for a first team (the Pros); (2) keeping track of offensive and defensive statistics for a second team (the Joes); (3) keeping track of offensive statistics for both teams; and (4) keeping track of defensive statistics for both teams. A user may tap one of the option icons 250, and the specific statistician mode interfaces that are responsively displayed to the user may be determined responsively.

In some embodiments, the system may be configured such that a game requires two statisticians (e.g., for redundancy, division of labor, and/or accountability). In some embodiments, two or more statisticians for the same game may divide responsibilities for the game by selecting two or more of the different statistician modes offered at a mode selection interface such as interface 206*i*.

In some embodiments, selection of a statistician mode at interface 206*i* may automatically cause the display of interface 206*j*.

Figure 2J:
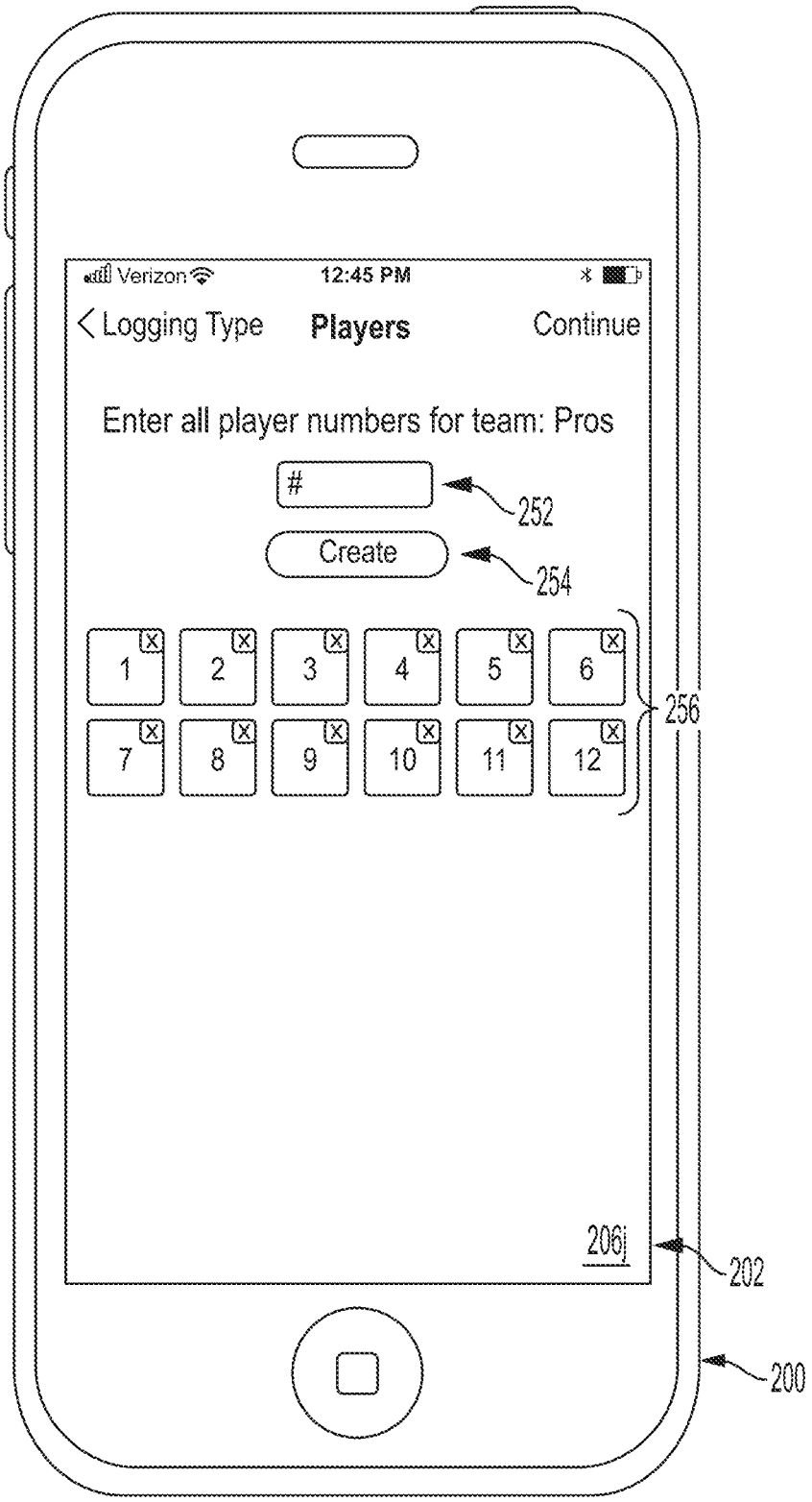

FIG. 2J shows interface 206*j*, which is a second statistician game setup interface. Specifically, as shown, interface 206*j* prompts the user to input information regarding the jersey numbers of players playing for a team in the game. A user may be prompted to enter jersey numbers and/or any additional or alternative identifying information about one or more of the players in the game. In the example shown, interface 206*j* comprises field 252, jersey number creation icon 254, and added jersey number icons 256. In some embodiments, a user may type a jersey number to be added into field 252 and may then tap jersey number creation icon 254 to add an entry corresponding to the jersey number typed into field 252. After a jersey number entry has been added, a corresponding icon for the jersey number may be displayed as one of added jersey number icons 256. In the example shown in FIG. 2J, the user has already added jersey numbers 1-12. In some embodiments, a user may be able to remove a jersey number entry after it has been added, for example by tapping on the corresponding added jersey number icon and/or by tapping on an associated deletion icon, such as the "X" icons shown at the top right corner of each added jersey number icon 256.

In some embodiments, interface 206*j* may include one or more icons to return to a previous screen (e.g., interface 206*i*) or to advance to a next screen (e.g., interface 206*k*) after all jersey numbers have been added.

Figure 2K:
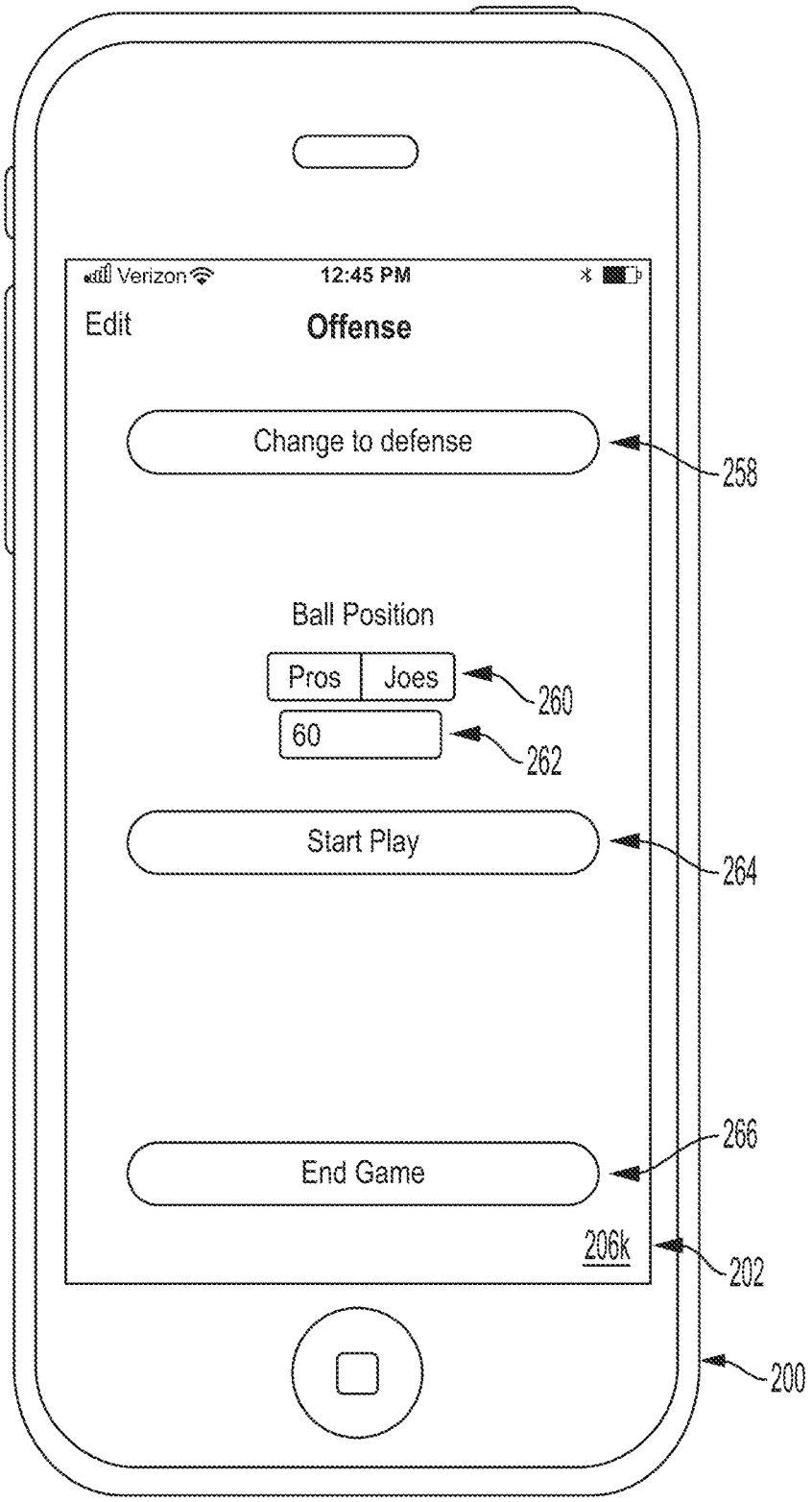

FIG. 2K shows interface 206*k*, which is an in-game statistician interface. In the example shown, interface 206*k* is an interface for recording statistics for the offensive team. As shown, interface 206*k* comprises offense/defense switching icon 258, ball position entry interface 260, start play icon 264, and end game icon 266.

In some embodiments, a user may switch from offensive statistician mode to defensive statistician mode by tapping icon 258. Depending on whether a user is in offensive statistician mode or defensive statistician mode, the user may be automatically prompted to record different statistics (e.g., statistics for the offensive team versus statistics for the defensive team) upon selecting start play icon 264 to begin recording statistics for a play.

In some embodiments, a user may indicate a ball position for the start of a play (e.g., before selecting start play icon 264) using ball position entry interface 260. In the example shown, a user may indicate a yard-line number by typing into a field of interface 260 and may select a side of the field by selecting from one of the two team names using toggle icons of interface 260.

In some embodiments, a user may indicate that the game has ended by tapping end game icon 266.

In some embodiments, a user may indicate that a play has started by tapping start play icon 264. In response to tapping start play icon, the system may cause device 200 to display one of several subsequent statistician interfaces for entering information about a play. The interfaces displayed may be determined by whether the user is in offensive statistician mode or defensive statistician mode. In some embodiments, the interfaces displayed may be dynamically determined as a user selects from among various options, navigating through the interfaces in a logical tree format to indicate information of increasing specificity at each subsequent interface. One example of such a set of interfaces is shown in FIGS. 2L-2O. In the example shown, in response to the user tapping start play icon 264, interface 206*i* *may be automatically displayed.*

Figure 2L:
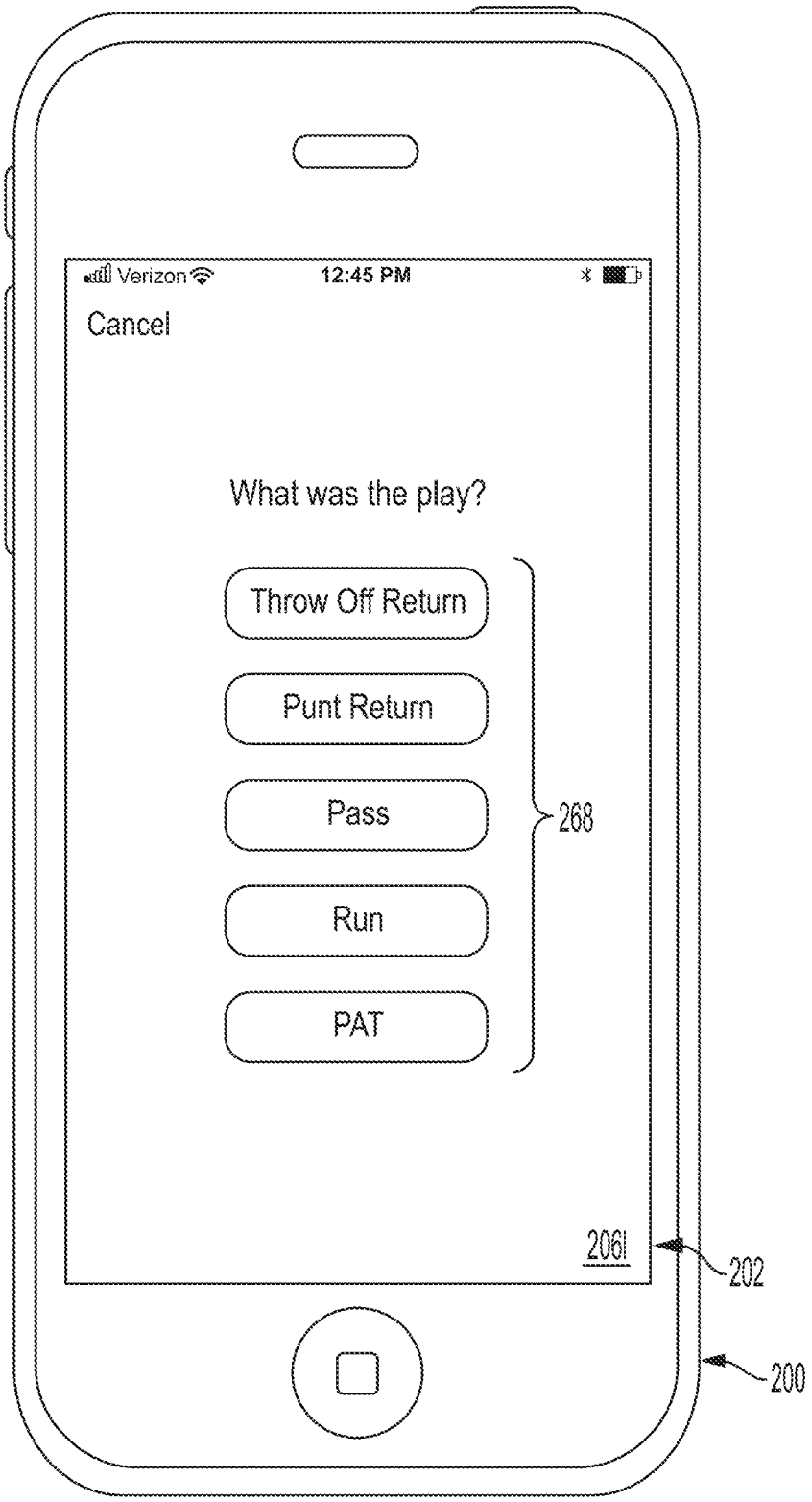

FIG. 2L shows interface 206*l*, which is a statistician interface for entering play information. Specifically, interface 206*l* is an interface for entering play information in offensive statistician mode. As shown in FIG. 2L, interface 206*l* prompts the user to select a type of play that has been run by the offense in the game by selecting one of a set of option icons 268. In the example shown, the five option icons 268 correspond to (1) a throw off return play, (2) a punt return play, (3) a pass play, (4) a run play, and (5) a point-after attempt (PAT) play. A user may tap one of the option icons 268 to cause the statistician mode to advance to a subsequent screen where additional information about the play executed may be entered. In the example shown in the figures, when a user taps the icon to indicate a pass play on interface 206*l*, interface 206*m* may be automatically displayed.

Figure 2M:
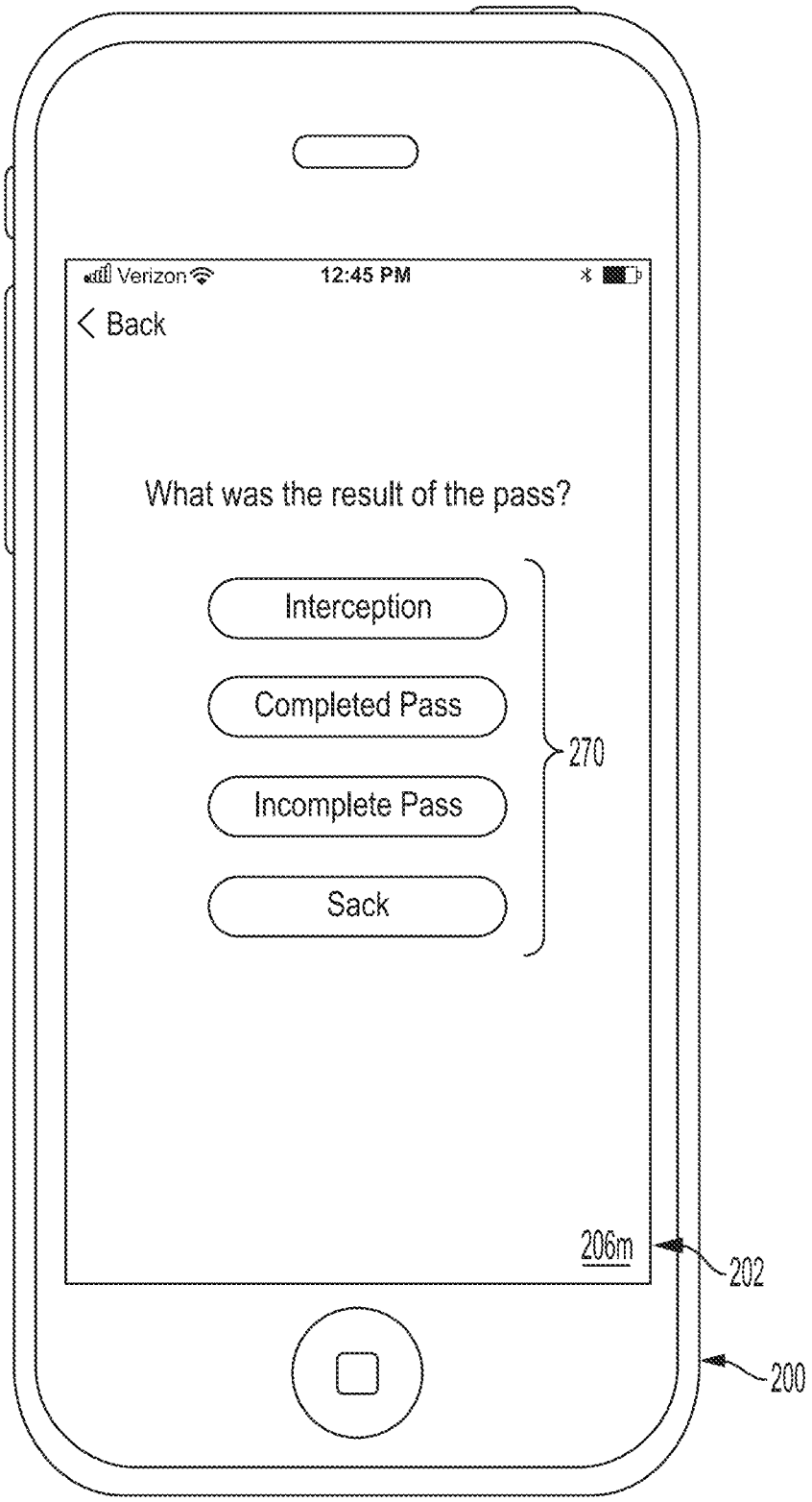

FIG. 2M shows interface 206*m*, which is a statistician interface for entering play information. Specifically, interface 206*m* is an interface for entering play information about a passing play in offensive statistician mode. As shown in FIG. 2M, interface 206*m* prompts the user to indicate the result of a pass play that has been run by the offense in the game by selecting one of a set of option icons 270. In the example shown, the four option icons 270 correspond to (1) an interception, (2) a completed pass, (3) an incomplete pass, and (4) a sack. A user may tap one of the option icons 270 to cause the statistician mode to advance to a subsequent screen where additional information about the pass play executed may be entered. In the example shown in the figures, when a user taps the icon on interface 206*m* to indicate that the play resulted in a completed pass, interface 206*n* may be automatically displayed.

Figure 2N:
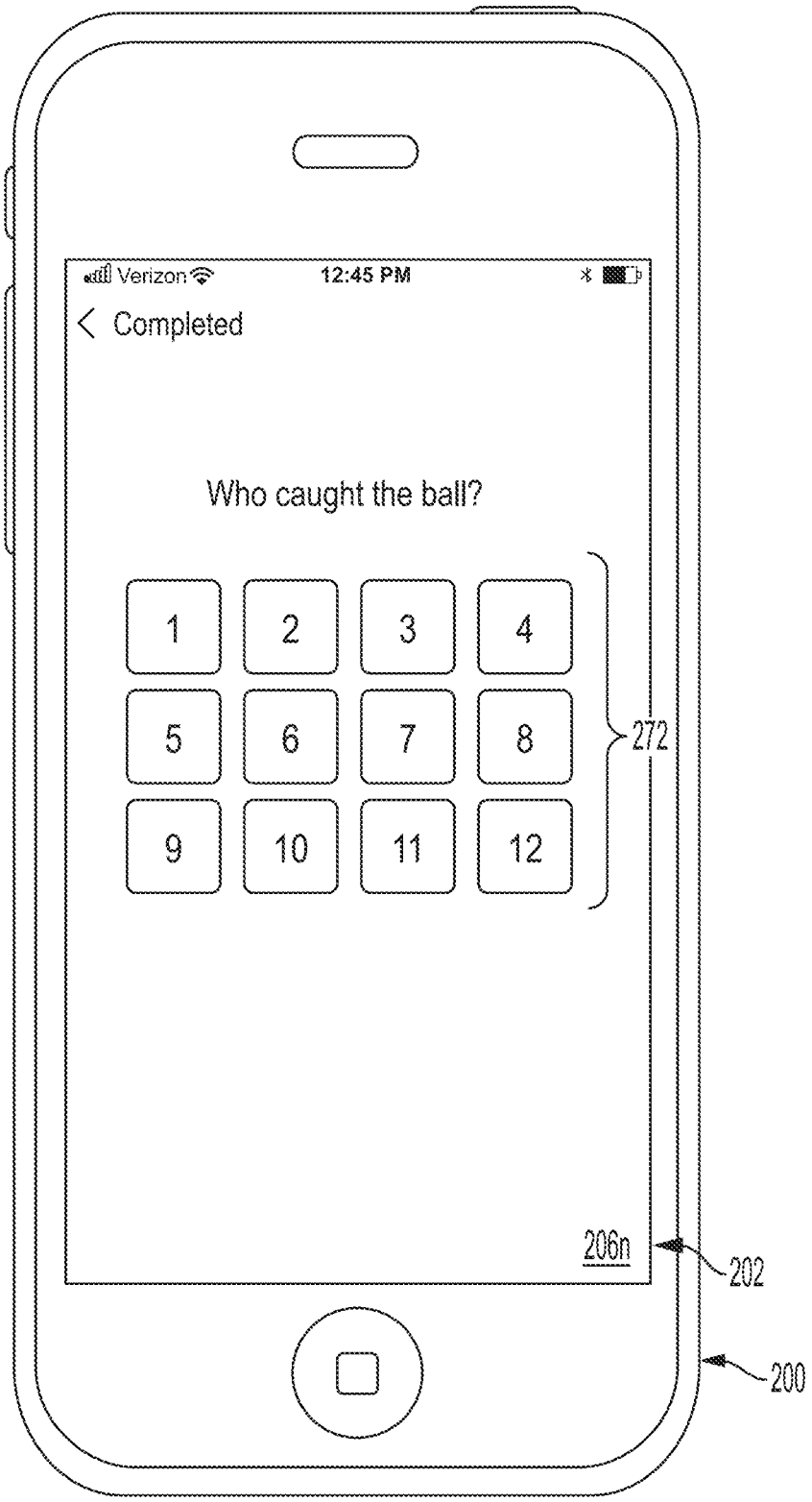
Figure 20:
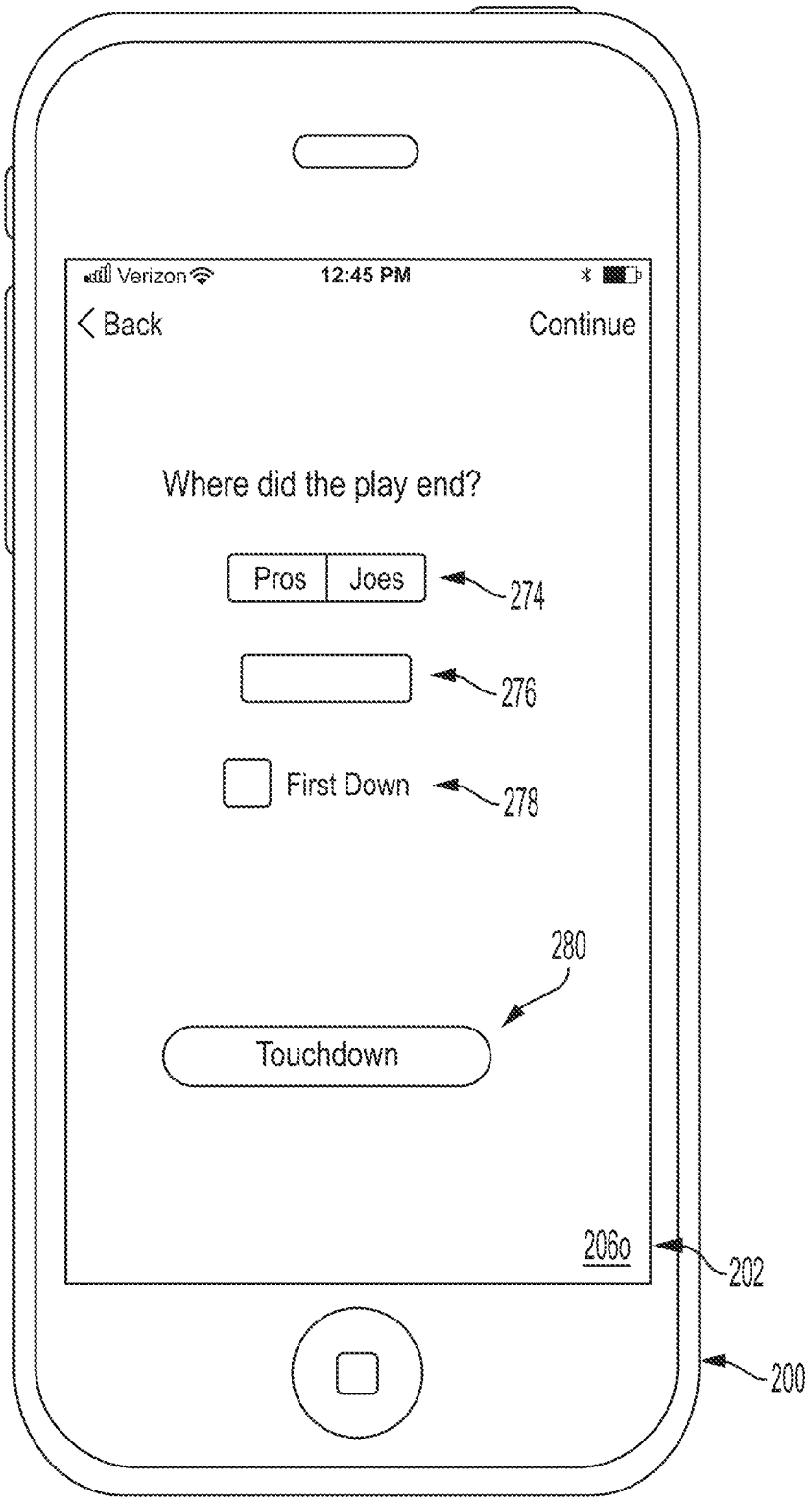

FIG. 2N shows interface 206*n*, which is a statistician interface for entering play information. Specifically, interface 206*n* is an interface for entering play information in offensive statistician mode about which player caught the ball on a passing play. As shown in FIG. 2N, interface 206*n* prompts the user to indicate the player who caught the ball on a pass play that has been run by the offense in the game by selecting one of a set of option icons 272. In some embodiments, option icons 272 may comprise player numbers, names, or other identifying information that may be used to identify and indicate a player. In some embodiments, the players displayed as options for option icons 272 may be determined by the players that were entered by a user during game setup (e.g., at interface 206*j*). In some embodiments, option icons 272 may include options for all players; in some embodiments, option icons 272 may include options for only a subset of players, such as only offensive players or only eligible receivers. In the example shown, option icons 272 correspond to jersey numbers 1-12. A user may tap one of the option icons 272 to cause the statistician mode to advance to a subsequent screen where additional information about the pass play executed may be entered. In the example shown in the figures, when a user taps the icon on interface 206*n* to indicate the player that caught the pass, interface 206*o* *may be automatically displayed.*

FIG. 2O shows interface 206*o*, which is a statistician interface for entering play information. Specifically, interface 206*o* is an interface for entering play information in offensive statistician mode about where and how a play ended. As shown in FIG. 2O, interface 206*o* comprises As shown, interface 206*o* comprises, ball position entry interface 274, first down entry interface 278, and touchdown icon 280.

In some embodiments, a user may indicate a ball position for the end of the completed play (e.g., before selecting one or more options to continue to a subsequent interface scree) using ball position entry interface 274. In the example shown, a user may indicate a yard-line number by typing into a field of interface 274 and may select a side of the field by selecting from one of the two team names using toggle icons of interface 274.

In some embodiments, a user may indicate that the play resulted in a first down by selecting first down entry interface 278. In the example shown, first down entry interface 278 is a check box that a user may tap to toggle between checked and unchecked before advancing to a subsequent interface screen.

In some embodiments, a user may indicate that the play resulted in a touchdown by tapping touchdown icon 280, which may in some embodiments cause a subsequent interface screen to automatically be displayed.

While the descriptions herein are made with reference to flag football, all or part of the devices, systems, methods, and techniques disclosed herein may be applied to facilitating officiating, spectating, and/or scorekeeping/stat-keeping other sports, as would be apparent to a person of ordinary skill in the art in light of the disclosures made herein.

Figure 3:
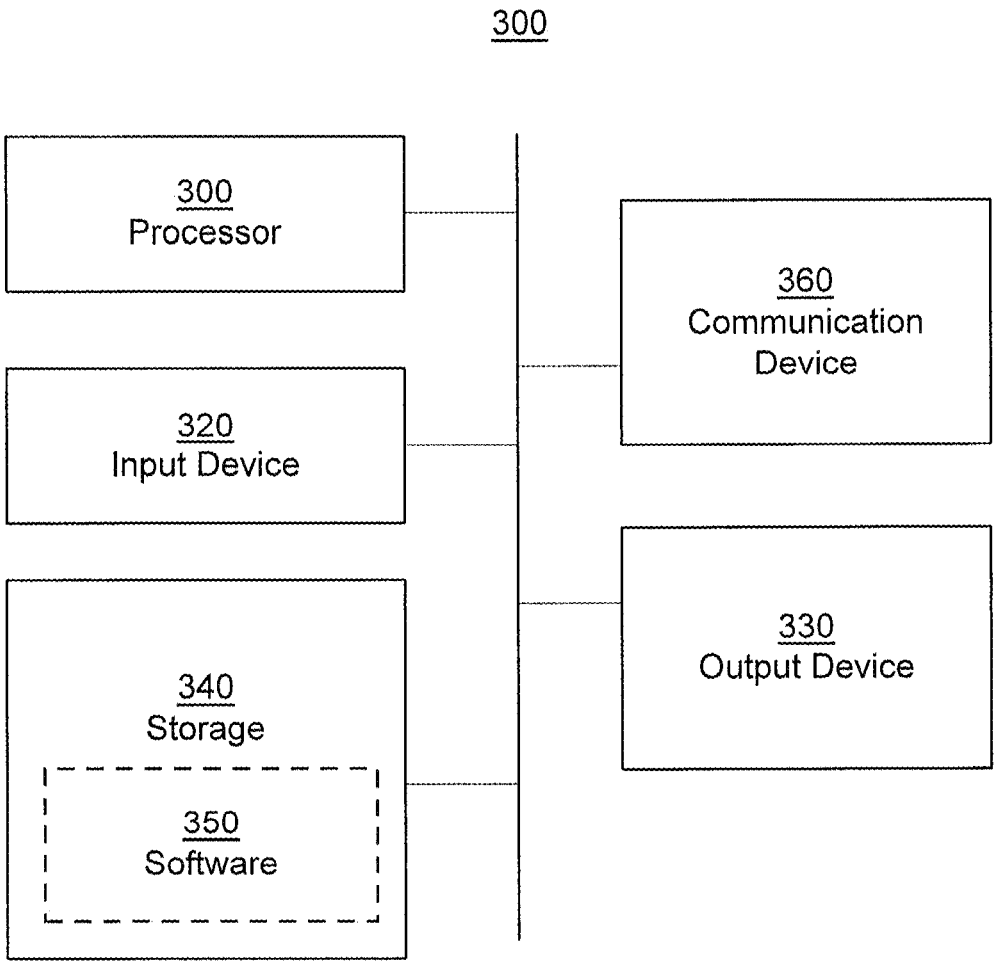
FIG. 3 shows a computer, in accordance with some embodiments.

FIG. 3 illustrates an example of a computer in accordance with one embodiment. Computer 300 can be a component of a mobile electronic device, flag football down marker, electronic flag football flag and/or belt, smart football, and/or any associated electronic device or system, such as a mobile electronic device 104, flag belt set 106, football 108, marker 110, mobile electronic device 112, remote server 114, and/or electronic device 200. In some embodiments, computer 300 is configured to execute a method for receiving, configuring, storing, configuring, distributing, synchronizing, and/or displaying information pertaining to officiating, playing, and spectating flag football, including receiving information from and sending information to electronic devices and/or flag football equipment associated with a flag football game.

Computer 300 can be a host computer connected to a network. Computer 300 can be a client computer or a server. As shown in FIG. 3, computer 300 can be any suitable type of microprocessor-based device, such as a personal computer, workstation, server, or handheld computing device, such as a phone or tablet. The computer can include, for example, one or more of processor 310, input device 320, output device 330, storage 340, and communication device 360.

Input device 320 can be any suitable device that provides input, such as a touch screen or monitor, keyboard, mouse, or voice-recognition device. Output device 330 can be any suitable device that provides output, such as a touch screen, monitor, printer, disk drive, or speaker.

Storage 340 can be any suitable device that provides storage, such as an electrical, magnetic, or optical memory, including a RAM, cache, hard drive, CD-ROM drive, tape drive, or removable storage disk. Communication device 360 can include any suitable device capable of transmitting and receiving signals over a network, such as a network interface chip or card. The components of the computer can be connected in any suitable manner, such as via a physical bus or wirelessly. Storage 340 can be a non-transitory computer-readable storage medium comprising one or more programs, which, when executed by one or more processors, such as processor 310, cause the one or more processors to execute methods and/or techniques described herein.

Software 350, which can be stored in storage 340 and executed by processor 310, can include, for example, the programming that embodies the functionality of the present disclosure (e.g., as embodied in the systems, computers, servers, and/or devices as described above). In some embodiments, software 350 can include a combination of servers such as application servers and database servers.

Software 350 can also be stored and/or transported within any computer-readable storage medium for use by or in connection with an instruction execution system, apparatus, or device, such as those described above, that can fetch and execute instructions associated with the software from the instruction execution system, apparatus, or device. In the context of this disclosure, a computer-readable storage medium can be any medium, such as storage 340, that can contain or store programming for use by or in connection with an instruction execution system, apparatus, or device.

Software 350 can also be propagated within any transport medium for use by or in connection with an instruction execution system, apparatus, or device, such as those described above, that can fetch and execute instructions associated with the software from the instruction execution system, apparatus, or device. In the context of this disclosure, a transport medium can be any medium that can communicate, propagate, or transport programming for use by or in connection with an instruction execution system, apparatus, or device. The transport-readable medium can include, but is not limited to, an electronic, magnetic, optical, electromagnetic, or infrared wired or wireless propagation medium.

Computer 300 may be connected to a network, which can be any suitable type of interconnected communication system. The network can implement any suitable communications protocol and can be secured by any suitable security protocol. The network can comprise network links of any suitable arrangement that can implement the transmission and reception of network signals, such as wireless network connections, T1 or T3 lines, cable networks, DSL, or telephone lines.

Computer 300 can implement any operating system suitable for operating on the network. Software 350 can be written in any suitable programming language, such as C, C++, Java, or Python. In various embodiments, application software embodying the functionality of the present disclosure can be deployed in different configurations, such as in a client/server arrangement or through a Web browser as a Web-based application or Web service, for example.

The foregoing description, for purpose of explanation, has been described with reference to specific embodiments. The illustrative embodiments described above, however, are not intended to be exhaustive or to limit the disclosure to the precise forms disclosed. Many modifications and variations are possible in view of the above teachings. The embodiments were chosen and described to best explain the principles of the disclosed techniques and their practical applications. Others skilled in the art are thereby enabled to best utilize the techniques and various embodiments with various modifications as are suited to the particular use contemplated.

Although the disclosure and examples have been fully described with reference to the accompanying figures, it is to be noted that various changes and modifications will become apparent to those skilled in the art. Such changes and modifications are to be understood as being included within the scope of the disclosure and examples as defined by the claims.

The invention claimed is:

1. A device for displaying and controlling timing information for officiating a flag football game, the device comprising:

a touch-screen display;

one or more processors; and memory storing instructions that, when executed by the one or more processors, cause the device to:

display a graphical user interface comprising score information of a flag football game, game clock information of the game, down information of the game, and a first icon associated with a first timer and a second timer of the game, each of the first and second timer being distinct from the game clock;

detect a first input at a location on the touch-screen display corresponding to the first icon;

in response to detecting the first input, display the first timer;

while the first timer is displayed, detect a second input; and in response to detecting the second input, cease to display the first timer and display the second timer.

2. The device of claim 1, wherein the first timer counts down from a predetermined number of seconds and is associated with a delay-of-game rule.

3. The device of claim 1, wherein the second timer counts up from zero seconds and is associated with one or more of a go-clock rule and a throw-clock rule.

4. The device of claim 1, wherein detecting the second input comprises detecting a touch input at a location of the touch-screen display corresponding to a displayed user-interface object.

5. The device of claim 1, wherein the instructions further cause the device to:

in response to detecting the first input, send a first wireless electronic signal to one or more associated electronic devices, the first signal comprising instructions to display information regarding the first timer; and in response to detecting the second input, send a second wireless electronic signal to the one or more associated electronic devices, the second signal comprising instructions to cease displaying information regarding the first timer and to display information regarding the second timer.

6. The device of claim 5, wherein the one or more associated electronic devices comprise one or more of a portable electronic device, an electronic football sideline marker, and a scoreboard.

7. The device of claim 1, wherein the instructions further cause the device to:

in response to detecting that the first timer has expired, generate and output a first notification; and in response to detecting that the second timer has expired, generate and output a second notification distinct from the first notification.

8. The device of claim 7, wherein:

the first notification comprises a first audible notification emitted by a speaker of the device; and the second notification comprises second audible notification, distinct from the first audible notification, emitted by the speaker of the device.

9. The device of claim 7, wherein:

the first notification comprises a third wireless electronic signal directed to one or more associated electronic devices, the third signal comprising instructions for the one or more associated electronic devices to generate and output a third audible or visible notification; and the second notification comprises a fourth wireless electronic signal directed to one or more associated electronic devices, the fourth signal comprising instructions for the one or more associated electronic devices to generate and output a fourth audible or visible notification, distinct from the third audible or visible notification.

10. A non-transitory computer-readable storage medium storing instructions for displaying timing information for officiating a flag football game, the instructions configured such that, when the instructions are executed by one or more processors of a system, the instructions cause the system to:

display a graphical user interface comprising score information of a flag football game, game clock information of the game, down information of the game, and a first icon associated with a first timer and a second timer of the game, each of the first and second timer being distinct from the game clock;

detect a first input at a location on the touch-screen display corresponding to the first icon;

in response to detecting the first input, display the first timer;

while the first timer is displayed, detect a second input; and in response to detecting the second input, cease to display the first timer and display the second timer.

11. The non-transitory computer-readable storage medium of claim 10, wherein detecting the second input comprises detecting a touch input at a location of the touch-screen display corresponding to a displayed user-interface object.

12. A method for displaying timing information for officiating a flag football game, the method comprising:

at a system comprising a touch-screen display, one or more processors, and memory:

displaying a graphical user interface comprising score information of a flag football game, game clock information of the game, down information of the game, and a first icon associated with a first timer and a second timer of the game, each of the first and second timer being distinct from the game clock;

detecting a first input at a location on the touch-screen display corresponding to the first icon;

in response to detecting the first input, displaying the first timer;

while the first timer is displayed, detecting a second input; and in response to detecting the second input, ceasing to display the first timer and displaying the second timer.

13. The method of claim 12, wherein the first timer counts down from a predetermined number of seconds and is associated with a delay-of-game rule.

14. The method of claim 12, wherein the second timer counts up from zero seconds and is associated with one or more of a go-clock rule and a throw-clock rule.

15. The method of claim 12, wherein detecting the second input comprises detecting a touch input at a location of the touch-screen display corresponding to a displayed user-interface object.

16. The method of claim 12, wherein the instructions further cause the device to:

in response to detecting the first input, send a first wireless electronic signal to one or more associated electronic devices, the first signal comprising instructions to display information regarding the first timer; and in response to detecting the second input, send a second wireless electronic signal to the one or more associated electronic devices, the second signal comprising instructions to cease displaying information regarding the first timer and to display information regarding the second timer.

17. The method of claim 16, wherein the one or more associated electronic devices comprise one or more of a portable electronic device, an electronic football sideline marker, and a scoreboard.

18. The method of claim 12, wherein the instructions further cause the device to:

in response to detecting that the first timer has expired, generate and output a first notification; and in response to detecting that the second timer has expired, generate and output a second notification distinct from the first notification.

19. The method of claim 18, wherein:

the first notification comprises a first audible notification emitted by a speaker of the device; and the second notification comprises second audible notification, distinct from the first audible notification, emitted by the speaker of the device.

20. The method of claim 18, wherein:

the first notification comprises a third wireless electronic signal directed to one or more associated electronic devices, the third signal comprising instructions for the one or more associated electronic devices to generate and output a third audible or visible notification; and the second notification comprises a fourth wireless electronic signal directed to one or more associated electronic devices, the fourth signal comprising instructions for the one or more associated electronic devices to generate and output a fourth audible or visible notification, distinct from the third audible or visible notification.

* * * * *